US006382922B1

(12) United States Patent
Lewis et al.

(10) Patent No.: US 6,382,922 B1
(45) Date of Patent: May 7, 2002

(54) GROUT PUMPS, CONTROL BOXES AND APPLICATOR TOOLS, AND METHODS FOR USING THE SAME

(75) Inventors: Darrin Wayne Lewis, Murray; Robert A. Marrott, Heber, both of UT (US)

(73) Assignee: MudMaster, LLC, Park City, UT (US)

( * ) Notice: Subject to any disclaimer, the term of this patent is extended or adjusted under 35 U.S.C. 154(b) by 0 days.

(21) Appl. No.: 09/676,607

(22) Filed: Sep. 28, 2000

Related U.S. Application Data

(60) Provisional application No. 60/156,763, filed on Sep. 29, 1999, and provisional application No. 60/187,740, filed on Mar. 8, 2000.

(51) Int. Cl.[7] ..... F04B 49/00; F04B 15/02; F04B 23/08

(52) U.S. Cl. ..... 417/38; 417/900; 417/199.1

(58) Field of Search ..... 417/38, 199.1, 417/245, 379, 900

(56) References Cited

U.S. PATENT DOCUMENTS

| | | | | |
|---|---|---|---|---|
| 4,090,914 A | | 5/1978 | Hauk et al. | 156/523 |
| 4,201,484 A | * | 5/1980 | Sasiela et al. | 366/153 |
| 4,440,410 A | | 4/1984 | Bradshaw | 280/47.26 |
| 4,533,300 A | * | 8/1985 | Westerlund et al. | 417/339 |
| 4,822,644 A | | 4/1989 | Krueger | 427/280 |
| 4,878,621 A | | 11/1989 | Krueger | 239/458 |
| 4,907,955 A | | 3/1990 | Snipes | 425/87 |
| 4,948,054 A | | 8/1990 | Mills | 239/325 |
| 4,996,941 A | | 3/1991 | Mills | 118/419 |
| 5,013,389 A | | 5/1991 | Retti | 156/526 |
| 5,037,011 A | | 8/1991 | Woods | 222/394 |
| 5,122,038 A | * | 6/1992 | Malkoski | 417/313 |
| 5,137,386 A | | 8/1992 | Mower | 401/48 |
| 5,137,752 A | | 8/1992 | Mills | 427/179 |
| 5,188,263 A | | 2/1993 | Woods | 222/394 |
| 5,279,684 A | | 1/1994 | Retti | 156/71 |
| 5,279,700 A | | 1/1994 | Retti | 156/578 |
| 5,284,296 A | * | 2/1994 | Connors et al. | 239/10 |
| 5,328,096 A | | 7/1994 | Stenge et al. | 239/123 |

(List continued on next page.)

OTHER PUBLICATIONS

Speed Gem II Pictures Page (2 pages), Date not Available Or Known.

Premier Drywall Tool Co. brochure "The New Generation of Drywall Taping Tools" (4 pages), Date Not Available Or Known.

Renegade Tool brochure "The Future of Interior Finishing" (8 pages), Date Not Available Or Known.

Parts Diagrams for Automatic Taper, Automatic Taper Extention, Corner Box, etc. (12 pages) (Aug. 1, 1995), Date Not Available Or Known.

Advertisement for "The Cannon" and the "Apla–Pump" from www.all–wall.com (1 page).

Brochure "The Future of Drywall Finishing" form Renegade Tool ( 4 pages).

Renegade Tool, L.L.C. Price List (1 page).

Renegade Tool thank you letter regarding Mud Buggy (1 page).

*Primary Examiner*—Charles G. Freay
*Assistant Examiner*—Michael K. Gray
(74) *Attorney, Agent, or Firm*—Daniel McCarthy; Parsons, Behle & Latimer

(57) ABSTRACT

A grout slurry pumping system, and a grout slurry control box and associated tools are described. Methods of using the pumping system and control box are also described. The pumping system and control box may be used separately or together. The pumping system maintains a grout slurry of desired consistency and can provide it through a hose to remote locations. The control box operates to apply grout to a work surface in desired quantities and in desired amounts according to a control valve.

19 Claims, 29 Drawing Sheets

U.S. PATENT DOCUMENTS

| | | | | |
|---|---|---|---|---|
| 5,368,461 | A | 11/1994 | Murphy | 425/87 |
| 5,443,211 | A | 8/1995 | Young et al. | 239/146 |
| 5,570,953 | A | * 11/1996 | DeWall | 366/10 |
| 5,605,251 | A | 2/1997 | Retti | 222/1 |
| 5,655,691 | A | 8/1997 | Stern et al. | 222/402.1 |
| 5,674,057 | A | 10/1997 | Guardiani et al. | 417/423.3 |
| 5,711,462 | A | 1/1998 | Hard | 222/385 |
| 5,711,483 | A | 1/1998 | Hays | 239/71 |
| 5,730,819 | A | 3/1998 | Retti | 156/71 |
| 5,759,343 | A | 6/1998 | Roberts | 156/678 |
| 5,771,525 | A | 6/1998 | Fulcher et al. | 15/244.1 |
| 5,863,146 | A | 1/1999 | Denkins et al. | 401/188 R |
| 5,878,921 | A | 3/1999 | Chase et al. | 222/333 |
| 5,878,925 | A | 3/1999 | Denkins et al. | 222/608 |
| 5,882,691 | A | 3/1999 | Conboy | 425/87 |
| 5,902,451 | A | 5/1999 | O'Mara et al. | 156/579 |
| 5,924,598 | A | 7/1999 | Bradshaw | 222/63 |
| 5,967,426 | A | 10/1999 | McLeod | 239/662 |
| 5,979,797 | A | 11/1999 | Castellano | 239/346 |
| 6,053,365 | A | 4/2000 | O'Mara et al. | 222/148 |

* cited by examiner

GROUT PUMPS, CONTROL BOXES AND APPLICATOR TOOLS, AND METHODS FOR USING THE SAME

CLAIM FOR PRIORITY

Priority is hereby claimed to U.S. Provisional patent application Ser. No. 60/156,763 filed on Sep. 29, 1999, and U.S. Provisional patent application Ser. No. 60/187,740 filed on Mar. 8, 2000.

BACKGROUND OF THE INVENTION

A. Field of the Inventions

The inventions relate to the field of pumps for pumping a slurry of grout to a remote location, tools for use at the remote location on a work surface. The inventions also related to control boxes and tools used for applying grout to a work surface in a controlled fashion. The inventions also relate to methods for accomplishing the foregoing.

B. Prior Art

There has been significant, but so far unsuccessful, effort in the prior art to construct group pumps, grout delivery systems, and grout applicator tools which provide for smooth and even application of grout to a construction surface. However, some of the prior art attempts to address the problem have yielded systems which either much be recharged with grout very frequently, thereby imposing a significant amount of down time and walking on the worker. Other prior art systems provide a continuous but uncontrollable flow of grout to the applicator tool, thus often oversupplying or undersupplying grout to the construction surface and resulting in an inferior finish.

U.S. Pat. No. 4,090,914 issued on May 23, 1978 discloses an apparatus for applying tape and adhesive to wallboard joints.

U.S. Pat. No. 4,440,410 issued on Apr. 3, 1984 discloses a hopper for containing drywall joint compound.

U.S. Pat. No. 4,822,644 issued on Apr. 18, 1989 discloses a projecting gun and nozzle which may be used to apply drywall coating material.

U.S. Pat. No. 4,878,621 issued on Nov. 7, 1989 discloses a projecting gun and nozzle for spraying material such as drywall material.

U.S. Pat. No. 4,907,955 issued on Mar. 13, 1990 discloses a drywall finishing tool.

U.S. Pat. No. 4,948,054 issued on Aug. 14, 1990 discloses a pneumatic drywall texture bazooka.

U.S. Pat. No. 4,996,941 issued in Mar. 5, 1991 discloses a wallboard taping system.

U.S. Pat. No. 5,013,389 issued on May 7, 1991 discloses a wallboard taping apparatus.

U.S. Pat. No. 5,037,011 issued on Aug. 6, 1991 discloses a spray-on surface texture dispenser for discharge of drywall texture.

U.S. Pat. No. 5,137,386 issued on Aug. 11, 1992 discloses a wallboard spotter tool.

U.S. Pat. No. 5,137,752 issued on Aug. 11, 1992 discloses a gypsum wallboard taping system.

U.S. Pat. No. 5,188,263 issued on Feb. 23, 1993 discloses a spray-on wall surface texture dispenser.

U.S. Pat. No. 5,279,684 issued on Jan. 18, 1994 discloses a wallboard taping apparatus.

U.S. Pat. No. 5,279,700 issued on Jan. 18, 1994 discloses an automated wallboard taping apparatus.

U.S. Pat. No. 5,328,096 issued on Jul. 12, 1994 discloses a spray on apparatus and method of operation for spraying heavy viscous material.

U.S. Pat. No. 5,368,461 issued on Nov. 29, 1994 discloses an outsider corner finishing tool.

U.S. Pat. No. 5,443,211 issued on Aug. 22, 1995 discloses a spray machine for giving a texture to drywall.

U.S. Pat. No. 5,570,953 issued on Nov. 5, 1996 discloses a mud mixing machine for drywall texturing.

U.S. Pat. No. 5,605,251 issued on Feb. 25, 1997 discloses a pulseless pump apparatus.

U.S. Pat. No. 5,655,691 issued on Aug. 12, 1997 discloses a spray texturing device for texturing a wall.

U.S. Pat. No. 5,674,057 issued on Oct. 7, 1997 discloses a submersible canned motor mixture pump.

U.S. Pat. No. 5,711,462 issued on Jan. 27, 1998 discloses a drywall tool filling pump.

U.S. Pat. No. 5,711,483 issued on Jan. 27, 1998 discloses a liquid spraying system controller including governor for reduced overshoot.

U.S. Pat. No. 5,730,819 issued on Mar. 24, 1998 discloses a dispensing apparatus and method for dispensing fluid material to a surface.

U.S. Pat. No. 5,759,343 issued on Jun. 2, 1998 discloses a taping gun mud pump apparatus.

U.S. Pat. No. 5,771,525 issued on Jun. 30, 1998 discloses a drywall and stucco application device.

U.S. Pat. No. 5,863,146 issued on Jan. 26, 1999 discloses an apparatus for applying joint compound.

U.S. Pat. No. 5,878,921 issued on Mar. 9, 1999 discloses a grout delivery apparatus with a flexible supply tube. The grout is supplied to a hand tool at a constant rate, although the rate may be pre-selected by the working through use of a switch.

U.S. Pat. No. 5,878,925 issued on Mar. 9, 1999 discloses a drywall joint compound pump workstation.

U.S. Pat. No. 5,882,691 issued on Mar. 16, 1999 discloses an automatic drywall compound applicator.

U.S. Pat. No. 5,902,451 issued on May 11, 1999 discloses an applicator for wallboard joint compound. The applicator includes a control valve for controlling the flow of mud.

U.S. Pat. No. 5,924,598 issued on Jul. 20, 1999 discloses a drywall mud storage and distribution system.

U.S. Pat. No. 5,967,426 issued on Oct. 19, 1999 discloses a knockdown portable liquid drywall material spray system apparatus.

U.S. Pat. No. 5,979,797 issued on Nov. 9, 1999 discloses a handheld pressurized hopper gun.

U.S. Pat. No. 6,053,365 issued on Apr. 25, 2000 discloses a texture pump and cleaner assembly.

SUMMARY OF THE INVENTIONS

For the purposes of this document, the term "grout" shall include viscous materials used in the construction trades, such as drywall compound, plaster, paste, stucco, adhesive, glue, aggregate slurry, concrete, and other liquid and semi-liquid pumpable materials.

Grout is often used to fill in cracks, depressions, divots or defects in drywall surfaces. A particular problem faced by the drywall worker is how to apply a desired quantity of grout to a drywall blemish in a controlled manner, from a device that is maneuverable and efficient to use.

Accordingly, it is an object of some embodiments of the inventions to provide a pumping system and hand tool which deliver grout to a worker in usable amounts.

It is a further object of some embodiments of the inventions to provide a pump system which provides a continuously and automatically adjustable supply of grout to a remote location.

It is a further object of some embodiments of the inventions to provide grout of adjustable consistency to a construction worker It is a further object of some embodiments of the inventions to provide a pumping system that maintains grout at a desired consistency, automatically adding water as necessary to provide thinner grout consistency.

It is a further object of some embodiments of the inventions to provide a handtool control box which may be used to apply grout to a work surface smoothly and in desired quantities.

It is a further object of some embodiments of the inventions to provide a grout pumping system that automatically mixes grout and water to a desired consistency before delivering it to a remote location for use.

It is a further object of some embodiments of the inventions to provide a handtool control box with a pressure-regulated valve that continuously adjusts the quantity of grout being supplied to a work surface.

It is a further invention of some embodiments of the invention to provide a handtool control box that automatically terminates grout flow when not in use.

These and other objects of the inventions will become apparent to persons of ordinary skill in the art upon reading the specification and viewing the appended drawings.

DETAILED DESCRIPTION OF SOME PREFERRED EMBODIMENTS

Below, one embodiment of the inventive concepts is described.

Slurry Pump System

Figure 1:
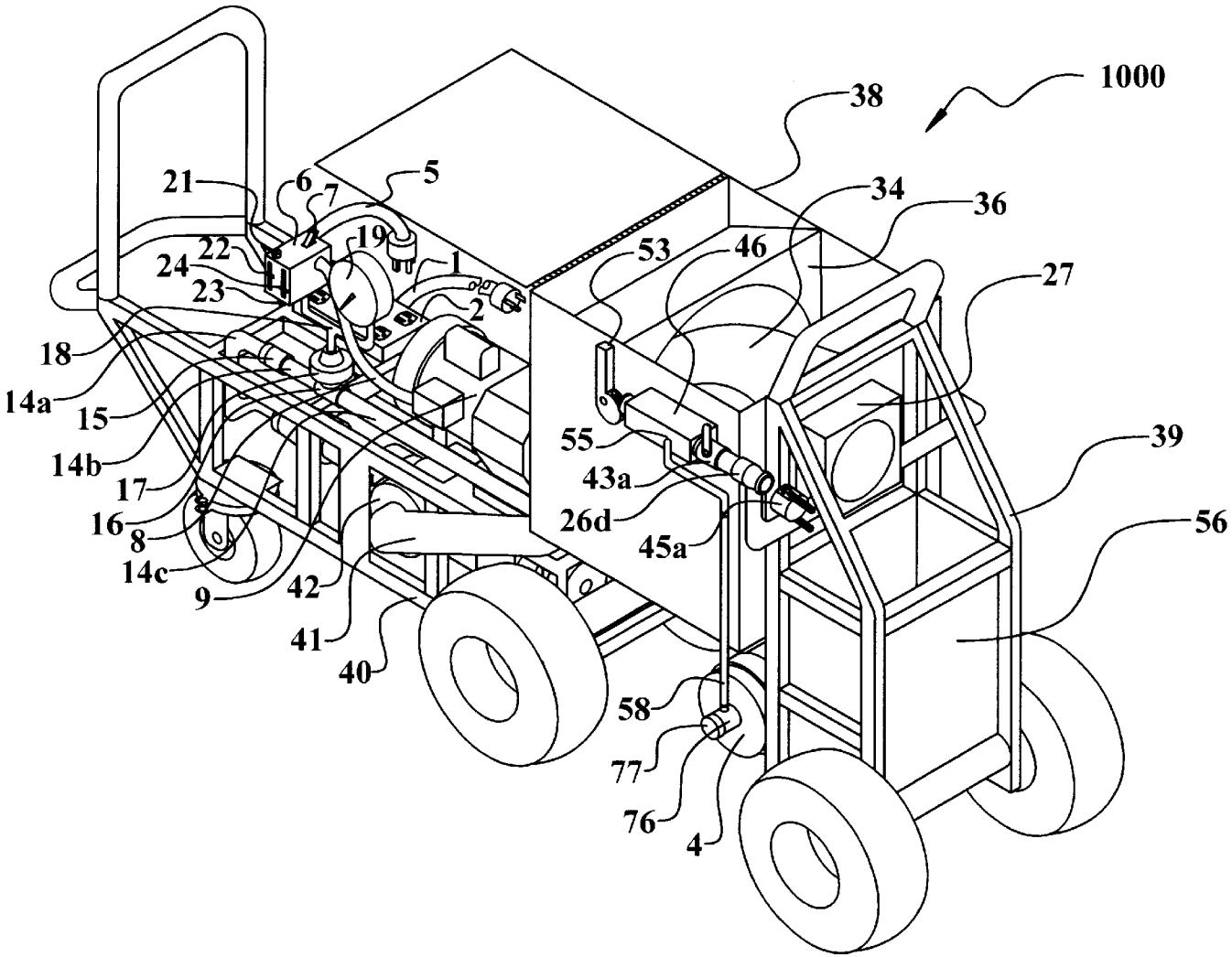
FIG. 1 depicts one embodiment of an automatic pump slurry system of the invention.
Figure 3:
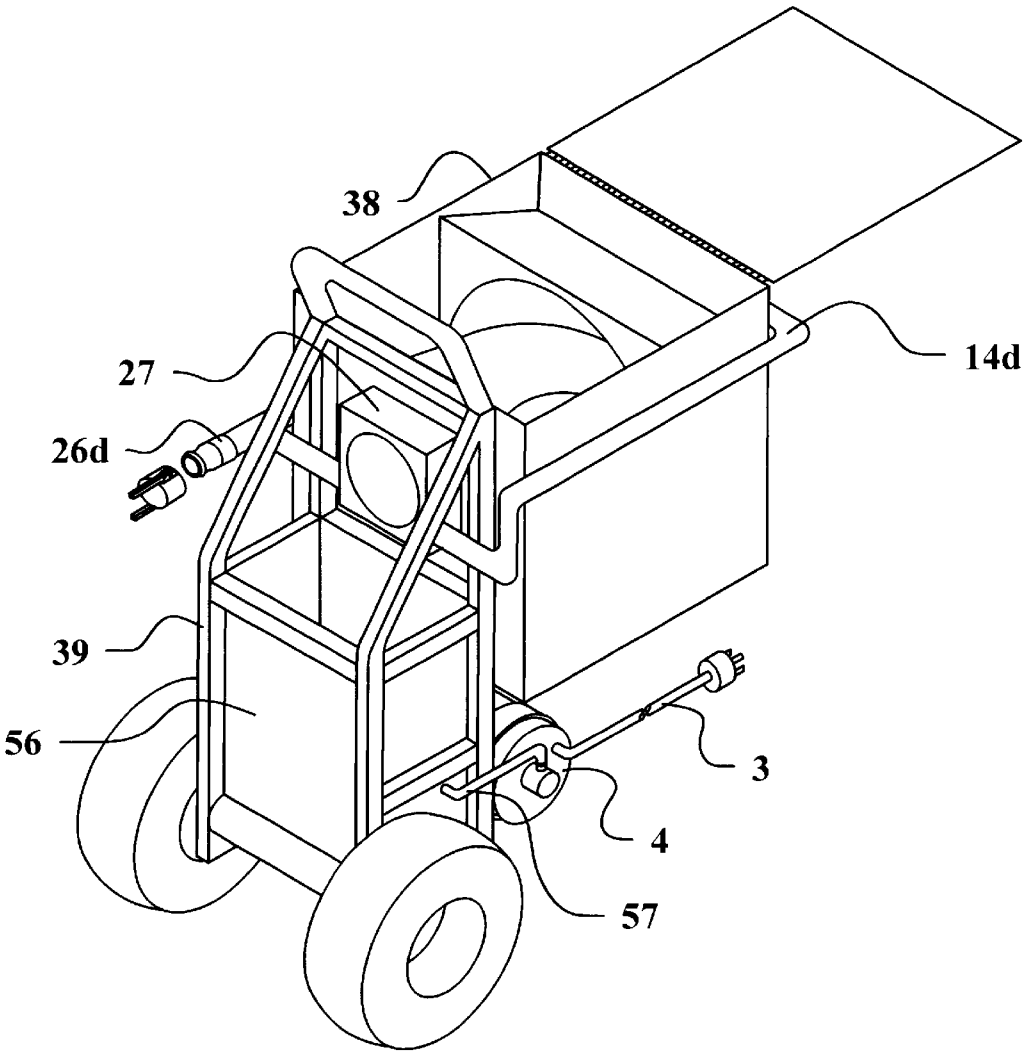
FIG. 3 depicts an embodiment of connection of a water pump to a slurry tank.

FIG. 1 depicts an automatic pump slurry system 1000 on a portable dolly 40. Main power cord 1 provides electricity to main power block 2 from which water pump cord 3 (FIG. 3) receives power for the water pump 4. The water pump 4 is depicted in FIG. 3 as well. The water pump 4 is pressure activated and turns on and off as needed to provide water to the system in order to keep the grout at a desired consistency.

A pressure sensor switch 6 is provided to keep the grout within the system pressurized so that the system is capable of providing grout to a remote location. Slurry sensor switch cord 5 plugs into the main power block 2 to receive electricity and provide it to slurry sensor switch 6. The toggle 7 of the pressure sensor switch is used to power the unit up for use and power it down for storage.

Figure 2:
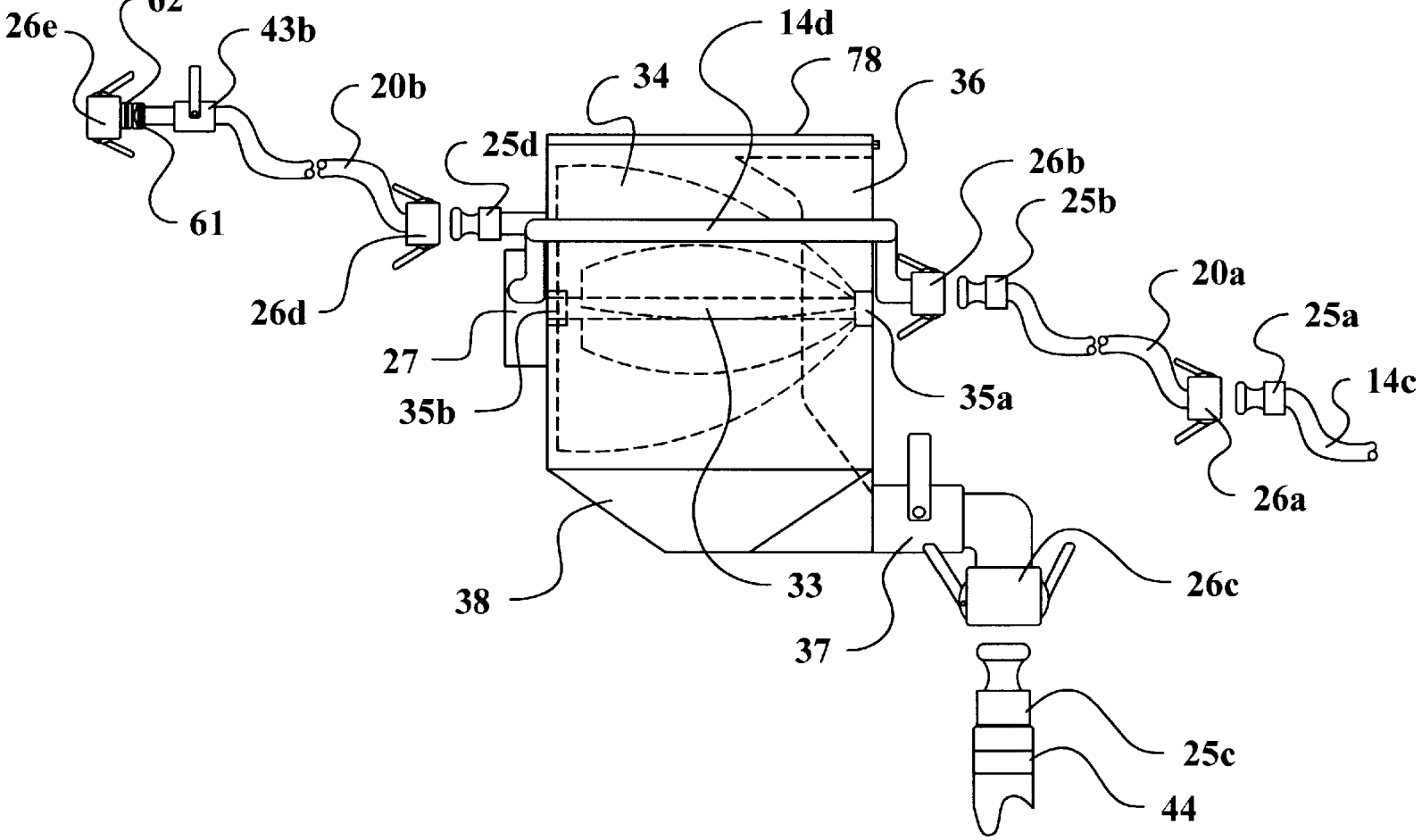
FIG. 2 depicts an embodiment of pipe and hose connections of the slurry system.

Referring to FIGS. 1, 5, 5*a* and 5*b*, when the slurry sensor switch 6 is turned on, it sends power through the motor cord 8, to the motor 9, which rotates the motor pulley 10. The motor pulley 10 turns the pulley belt 11 which rotates pump pulley 12 in order to power slurry pump 13. The slurry pump 13 forces a slurry of grout through pipe 14*a* past check valve 15. Pump 13 may be any appropriate pump, such as the Moyno Progressive Cavity Pump Model 72201GH from Moyno Industrial Products in Chicago, Ill. The motor 9 may be any appropriate motor such as the Emerson Model E514-TMP available from Emerson Electric Company, St. Louis, Mo. A gear box may be used with the motor, such gear box CBN2102S3136.MP1431 also from Emerson. The check valve 15 is a one-way valve which will not allow slurry to flow backward to the slurry pump 13. This ensures that any decrease in slurry pressure within the system can only caused by slurry escaping through the system pipe 14*a*–14*c* or system hose 20*a* and 20*b* (FIG. 2). Slurry pump 13 has a pump inlet 42 for receiving slurry from pump return 41 from the hopper 38.

While under pressure, grout slurry moves forward through system pipe 14*b* to system tee 16. As slurry pressure builds in slurry tee 16 putting pressure on diaphragm 17 which pushes on silicone in sensor pipe 18 which actuates slurry gauge 19. Consequently, gauge 19 provides a visual reading of slurry pressure.

The pressure within the system may be maintained within a predetermined range by pressure switch 6. An appropriate pressure switch is Model 25C1F2A available from United Electric Controls of Watertown, Mass. A high-pressure limit sensor (not shown) is set by the user by turning increase pressure screw 21, and is read by increase pressure sensor indicator 22. When slurry pressure in sensor pipe 18 increases to a sufficient level, it activates high-pressure sensor in slurry sensor switch 6, shutting off electricity to motor cord 8, turning off the motor and terminating further slurry pressure buildup. Electricity to motor cord 8 will then remain off until slurry escapes from the system, such as through system hose 20.

When slurry leaves the system, slurry pressure decreases thereby activating low-pressure sensor (not shown) in slurry sensor switch 6. The low-pressure switch is set by the user with low pressure screw 23 and is read by low pressure indicator 24. When slurry pressure decreases to the pre-set level, electricity to motor power cord 8 is turned on by the switch 6 in order to bring pressure up to the desired level, completing a cycle.

When fittings (further described in conjunction with FIG. 2) are connected, slurry can then flow to auger turbine 27, which powers auger 34. When switchover valve 43*a* is open and work outlet 26*d* is capped with cap 45*a* slurry is forced into slurry consistency valve 46, which senses slurry consistency and automatically adds water to slurry when needed.

Slurry consistency is maintained by use of water pressurized by a water pump. Referring to FIGS. 1 and 3, water is fed to from water tank 56 through water pump inlet hose 57 to water pump 4. Water pump 4 will automatically sense the system's need for water and begin pumping when necessary. Water is pumped through water pump outlet hose 58 through water inlet port 55. The water then blends with slurry and moves out to the hopper 38 thus creating a cycle. Cam lever 53 which is used to adjust consistency valve 46 and achieve the desired consistency of grout slurry.

A garden hose can be attached to water outlet 76 in order to use pressurized water for a variety of purposes. Water outlet can be shut off with cap 77 if a hose is not in use.

FIG. 2 depicts hose and pipe connections, auger function and hopper dolly to pump dolly connection. System pipe 14*c* (mentioned above), which is fed by the pump system, connects to system hose 20*a* by hose connections 25*a* and 26*a*. System hose 20*a* connects to system pipe 14*d* by hose connections 25*b* and 26*b*. Pipe 14*d* connects to turbine 27(shown in FIGS. 13 and 10) which powers auger 34 (shown in phantom). Auger shaft bearings 35*a* and 35*b* ensure easy rotation of auger shaft 33. As auger 34 rotates it mixes grout slurry and forces slurry toward slurry collector 36. This forces slurry to hopper valve 37. Hopper valve 37 is used to shut off slurry from hopper 38 while connecting or disconnecting hopper dolly mount 26*c* to or from pump dolly mount 25*c*.

Figures 5, 5A, 5B:
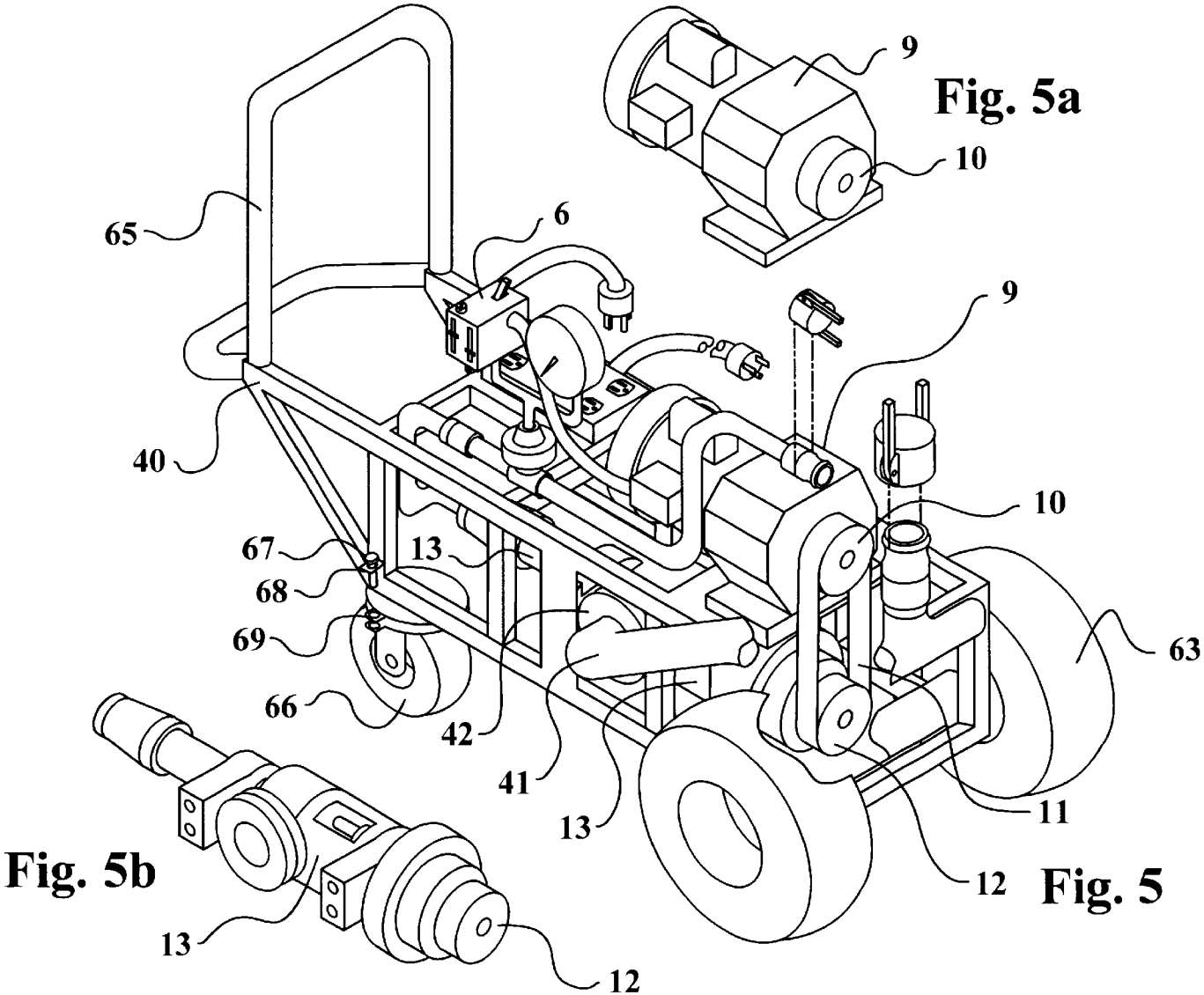
FIG. 5 depicts an embodiment of the motor and slurry pump.
FIG. 5*a* depicts an embodiment of a motor used in the system.
FIG. 5*b* depicts an embodiment of a pump used in the system.

When hopper valve 37 is turned on, slurry is forced through hopper mount 26*c* and dolly mount 25*c* and back to the slurry pump 13 (FIGS. 5 and 5*b*). When hopper dolly mount 26*c* connects to pump dolly mount 25*c* it creates a ball and hitch setup like used on a truck and trailer. Hopper dolly mount 26*c* acts as a hitch while pump dolly mount 25*c* acts as the ball.

Bearing 44 allows hopper dolly 39 to swivel with respect to pump dolly 40. Hopper lid 78 keeps slurry from drying out or becoming contaminated with debris.

Work pipe connection 25*d* connects to work hose 20*b* with work hose connection 26*d*. Work hose valve 43*b* acts as an emergency slurry shutoff. When valve 43*b* is in the off position, tools can be connected to connection 26*e* without loss of system pressure or loss of grout slurry.

Slurry screen 61 screens slurry for smoothness. Swivel connection 62 allows tool connection 26*e* to swivel with respect to work hose 20*b*. Work hose valve 43*b* also works as a faucet for turning slurry on and off to fill areas with slurry.

FIG. 3 depicts how water pump 4 is attached to water tank 56. Water is fed to water pump 4 through water inlet hose 57, which is gravity, fed by water tank 56. The water pump 4 then pumps water from the tank 56 to the hopper where it is utilized in the grout. The water pump 4 is pressure sensitive and is turned on an off as needed.

Figure 4:
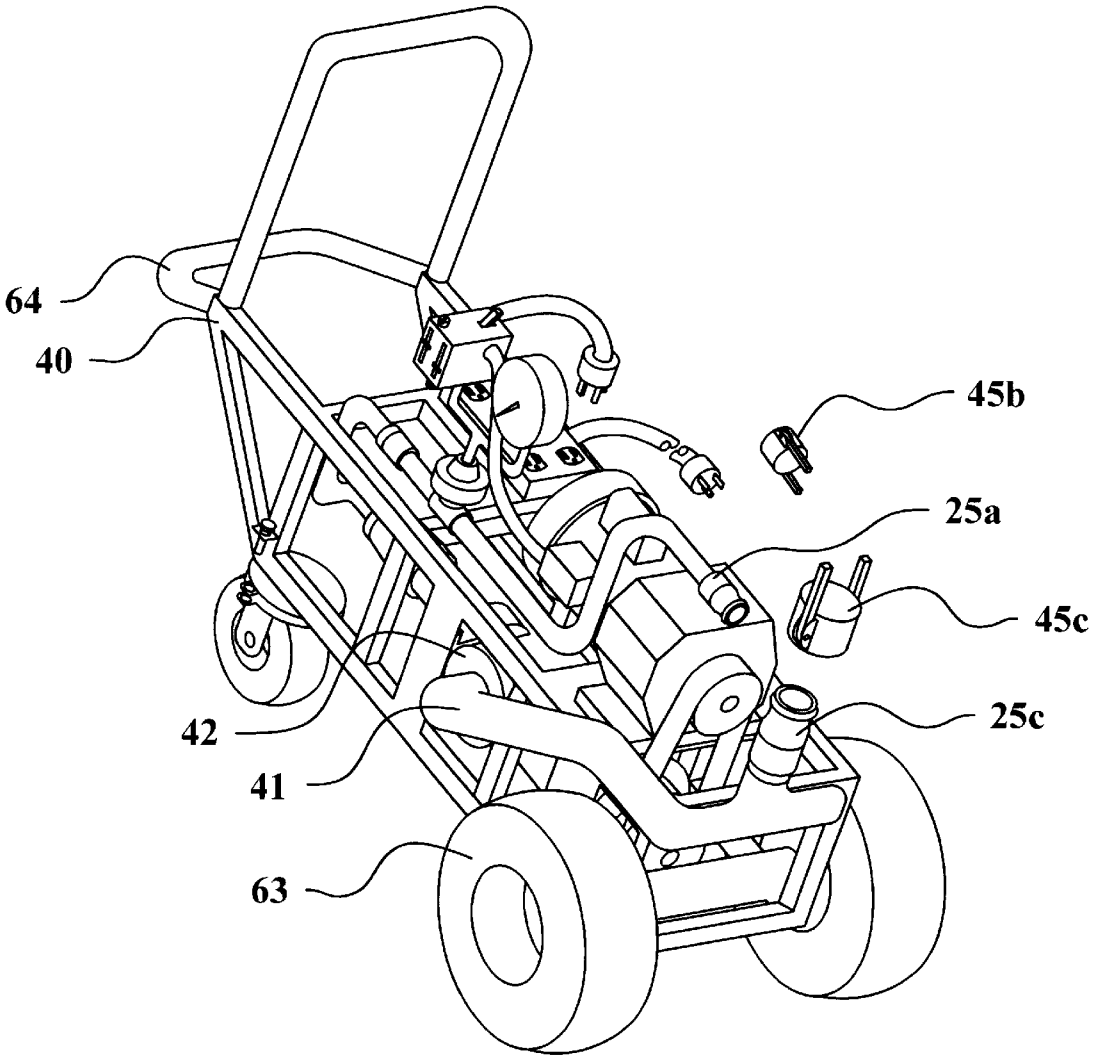
FIG. 4 depicts an embodiment of a pump dolly usable with the slurry system.

FIG. 4 depicts a pump dolly 40 used in some embodiments of the inventions. The pump dolly is used for transporting the system short distances, for loading and unloading the system, or moving the system over obstacles such as up or down stairs. Pump dolly 40 can be rolled in a horizontal position using rear pneumatic wheels/tires 63, and pulled by handle 64. Caps 45*b* and 45*c* are used to cap connections 25*a* and 25*c* when the machine is not in use.

FIG. 5 depicts pump dolly 40 when in a vertical position. FIG. 5*a* shows the motor 9 and FIG. 5*b* shows the slurry pump 13, apart from the assembled system on the dolly 40, for a better view.

When pump dolly 40 is in a vertical position it is pulled by handle 65. Pump dolly 40 can be rolled on all four wheels, including rear wheels 63 and front wheels 66. Front wheels are casters that may turn 360 degrees for easy handling, but may be locked in place by removing pin 67 from pin holder 68 and placing it in lock holes 69. Locking front wheels are useful when loading and unloading the machine.

Figure 6:
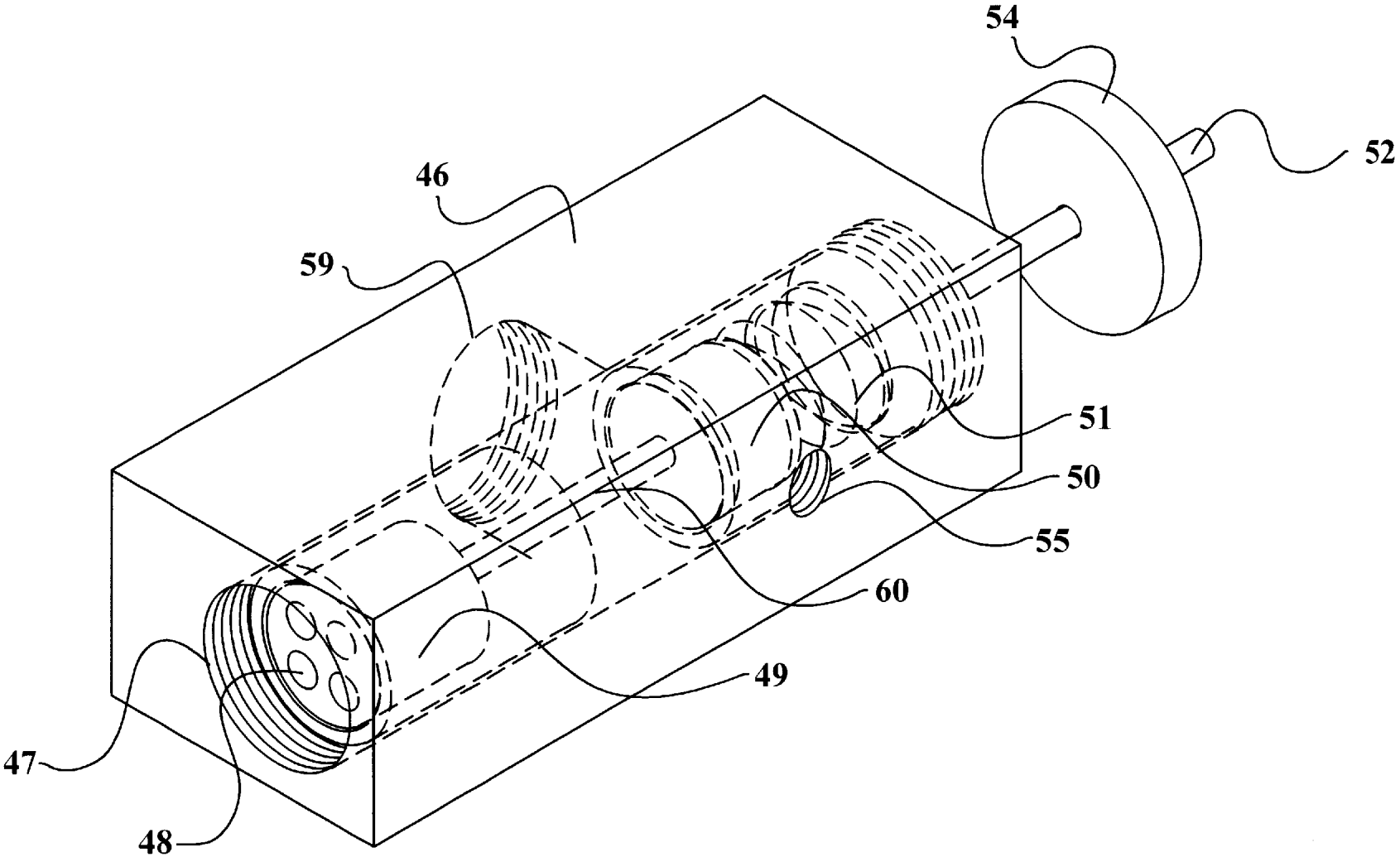
FIG. 6 depicts an embodiment of a consistency valve used in the system in its closed position.

FIG. 6 depicts consistency valve 46 in its closed position. Slurry enters through inlet 47 then passes through consistency ports 48. When slurry consistency is thin slurry passes through slurry consistency ports 48 with ease, putting no pressure on consistency piston 49 therefore leaving water inlet piston 50 in the off position, and allowing no water to mix with the slurry. However, the slurry is allowed to flow through consistency valve 46 and exiting through hopper return port 59. The pressure applied to push rod 52 exerts a corresponding force against water inlet piston 50, piston rod 60 and consistency piston 49 which, thereby regulating how much pressure is applied to consistency piston 49 before water inlet piston 50 clears water inlet port 55 and allows fresh water into the system.

Figure 7:
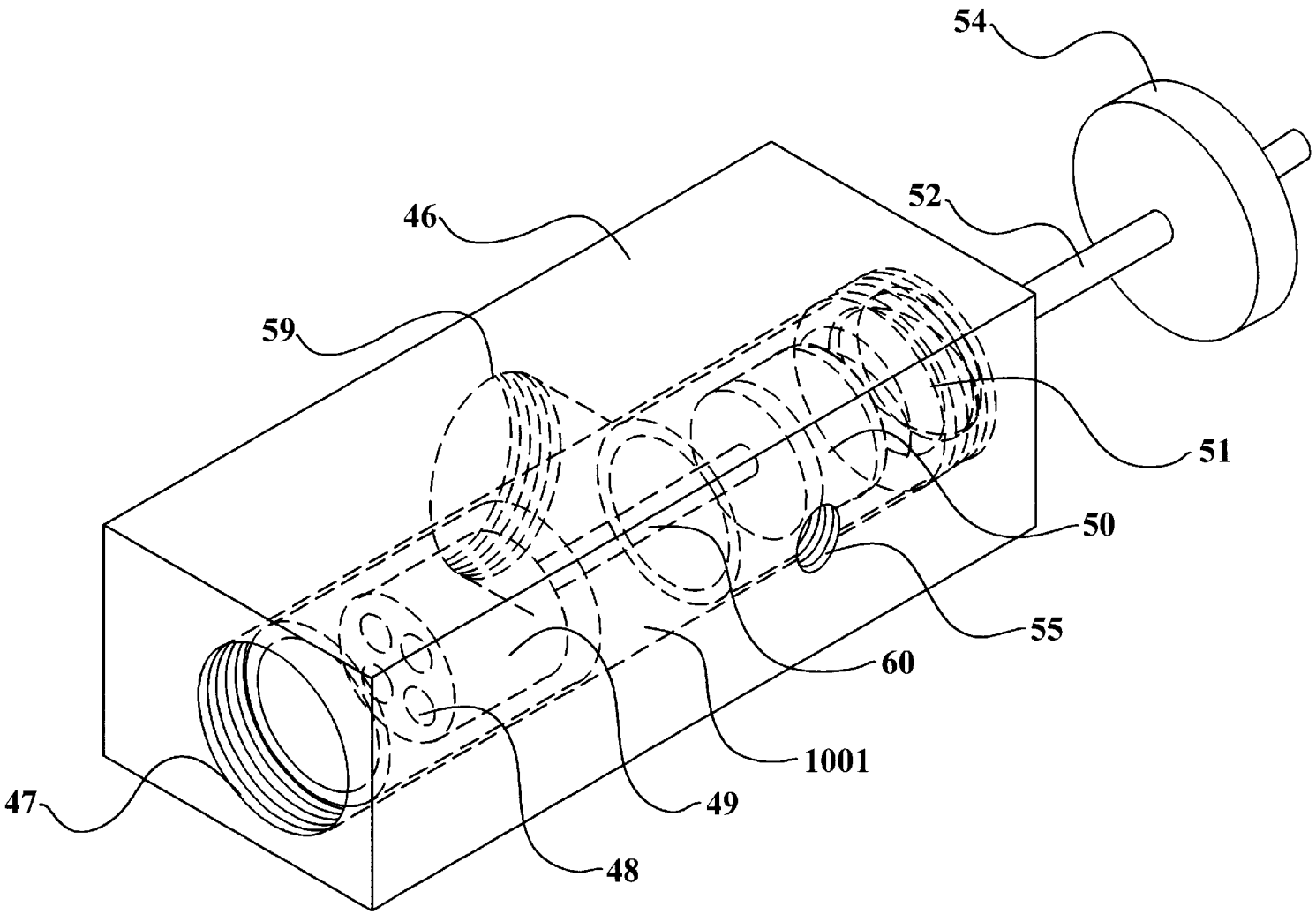
FIG. 7 depicts an embodiment of a consistency valve used in the system in its open position.

FIG. 7 depicts consistency valve 46 in its open position. Slurry enters through inlet 47 then passes through consistency ports 48. If the slurry is thick it is restricted when passing through consistency ports 48, which puts pressure on consistency piston 49. That pressure moves piston 49 along bore 1001, and also moves water inlet piston 50 along the interior of the bore 1001 because the piston 49 and the piston 50 are connected by piston rod 60. hen water inlet piston 50 is moved far enough through the bore, it unblocks water inlet port 55 thus allowing water to mix with the slurry and exit through the hopper return port.

Figure 8:
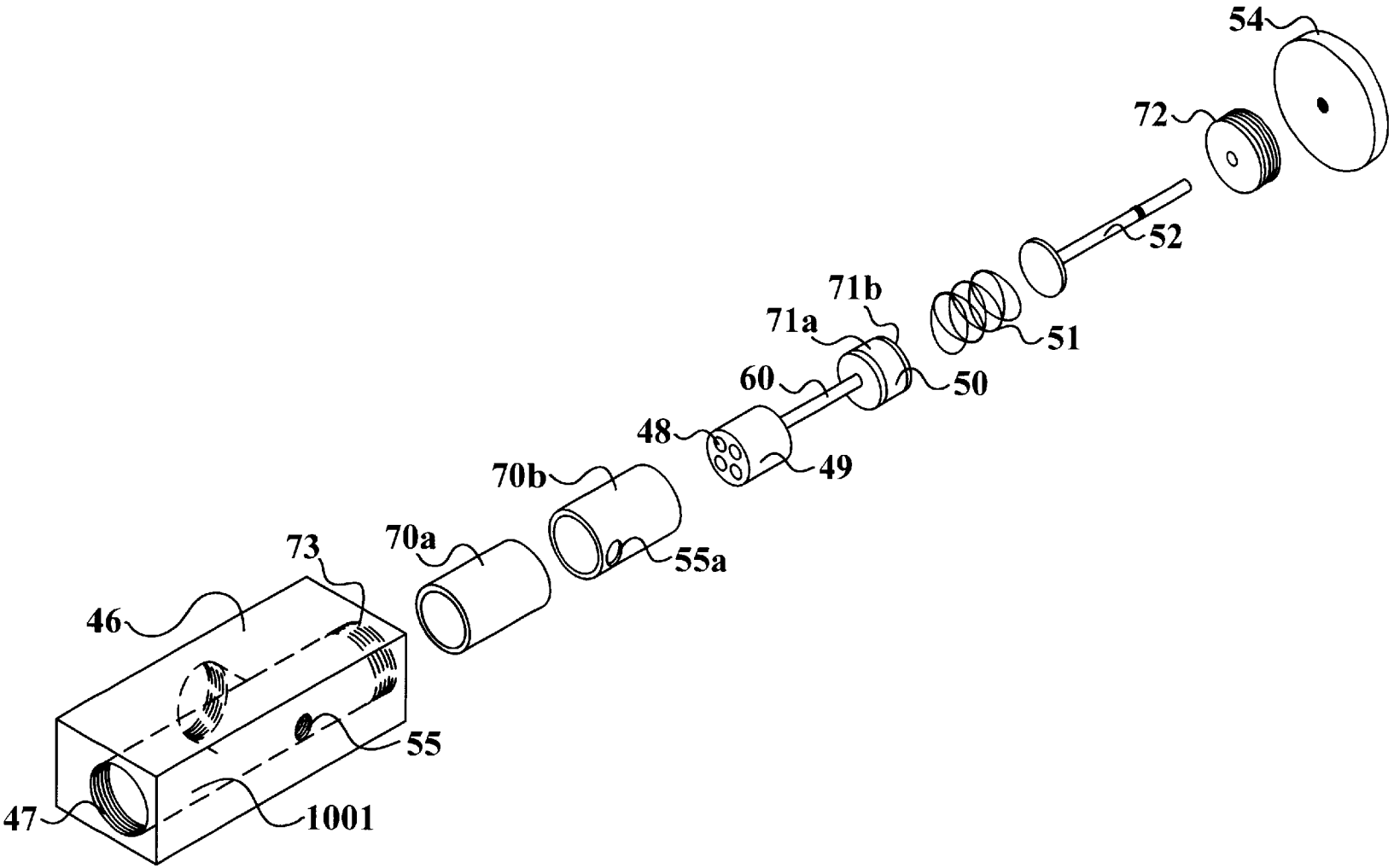
FIG. 8 depicts a parts explosion view of the valve of FIGS. 6 and 7.

FIG. 8 depicts a parts explosion of consistency valve 46. Cylinder sleeves 70*a* and 70*b* are pressed into the bore 1001 of consistency valve 46. Water inlet ports 55 and 55*a* line up creating a water passage. Water inlet seals 71*a* and 71*b* are show mounted on water inlet piston 50 to create a water-tight seal. Consistency piston 49 and water inlet piston 50 are connected by piston rod 60 and the entire unit is assembled in cylinder sleeves 70*a* and 70*b*. Next tension spring 51 is pushed into the cylinder sleeves, then pushrod 52 follows it. Next pushrod cap 72 is slid over pushrod 52 and threaded into cap hole 73 thus holding contents in place. Finally release grip 54 is threaded onto pushrod 52.

Figure 9A:
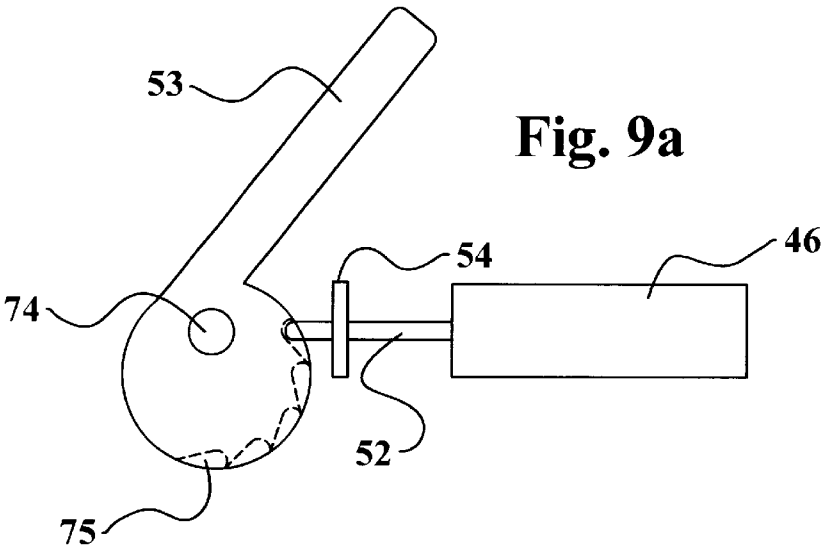
FIG. 9*a* depicts an embodiment of a cam lever used to adjust the consistency valve, in the position which delivers thin consistency.
Figure 9B:
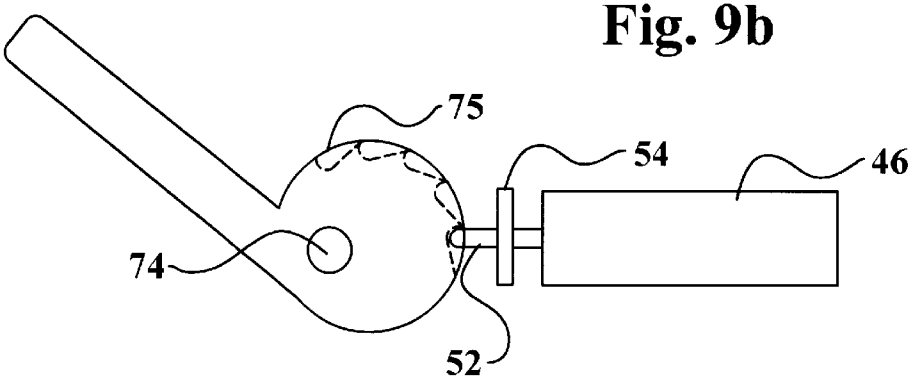
FIG. 9*b* depicts the lever of FIG. 9*a* in a position which delivers thick consistency.

FIGS. 9*a* and 9*b* depict a cam lever 53 which is used to adjust consistency valve 46. FIG. 9*a* depicts the cam lever 53 in its thin consistency position. Cam lever 53 rotates about pin 74 in order to position push rod locks 75 to hold pushrod 52 and release grip 54 in the desired position with respect to the consistency valve 46. In the position depicted, the release grip 54 and rod 52 are in a position that will allow a greater flow of water through the consistency valve 46 in order to provide a thin consistency slurry. FIG. 9*b* depicts the cam lever 53 in its thick consistency position. The cam lever 53 has been pulled away from the consistency valve, pushing the release grip 54 and rod 52 toward the consistency valve in order to cause less water to flow through the valve 46 and provide thicker consistency grout slurry. Push rod locks 75 hold cam lever 53 in place.

Figure 10:
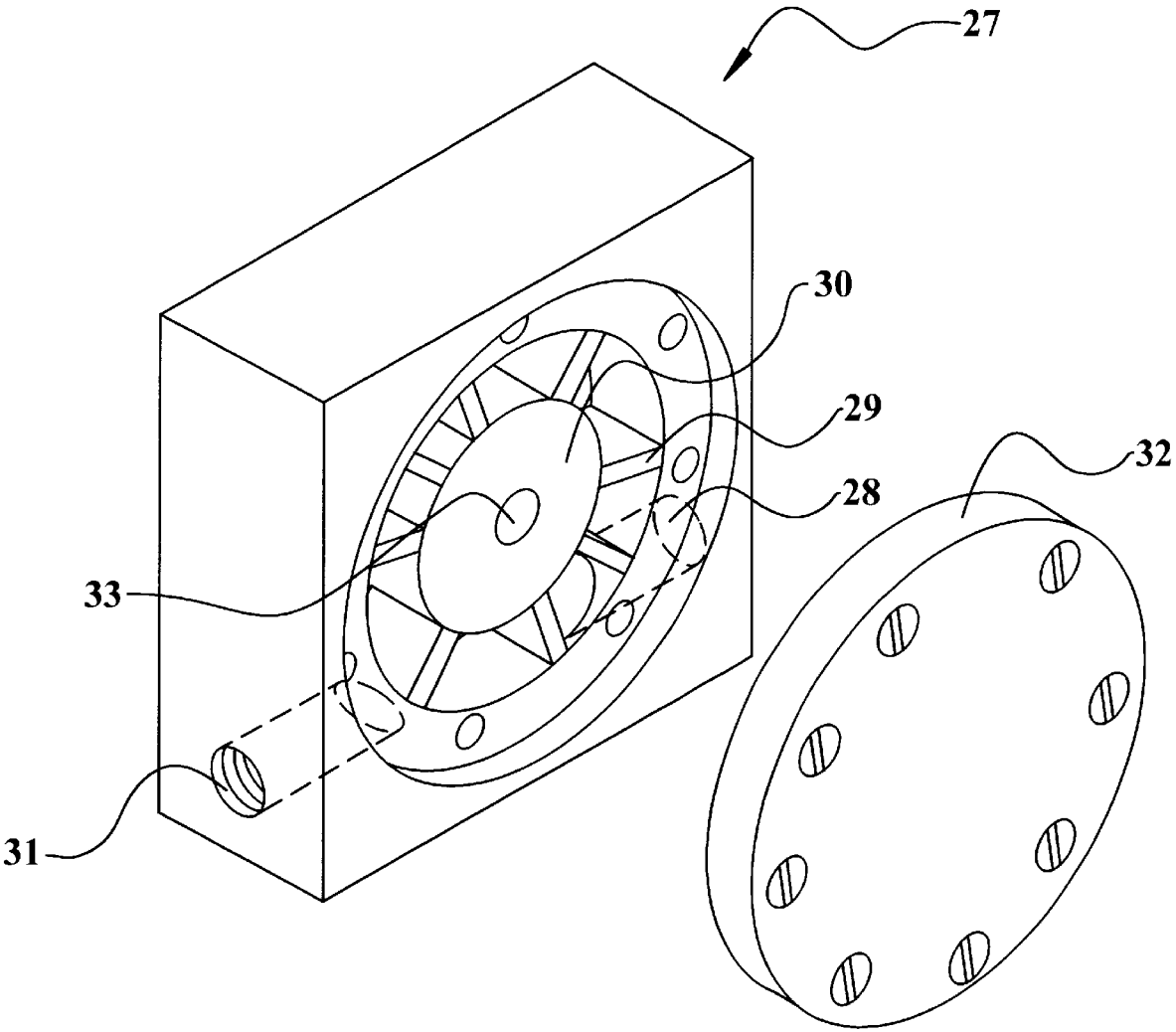
FIG. 10 depicts an embodiment of a turbine used in the inventions.

FIG. 10 depicts an internal view of auger turbine 27. The auger turbine 27 serves to force grout slurry to drive auger 34 (FIG. 1). Slurry enters the turbine 27 through turbine inlet 28. The slurry is under pressure and puts pressure on turbine fins 29, which turn turbine body 30. The slurry then exits through turbine outlet 31. Auger shaft 33 turns in conjunction with turbine body 30 thus rotating auger shaft 33. Turbine lid 32 screws in place on the turbine 27, creating a closed compartment so that slurry to travel in turbine inlet 28 and out turbine outlet 31. The auger 34 is rigidly mounted to the auger shaft 33, so that movement of slurry through the auger turbine 37 rotates the auger 34. The rotating auger 34 mixes the slurry to provide evenly mixed, consistent slurry.

In operation, the user places grout in the hopper and powers up the system. The grout pump will begin to operate, pumping grout to the turbine which turns the auger. The auger forces grout back to the grout pump.

The system keeps the grout a constant consistency by use of the consistency valve. When the grout becomes too thick or viscous, it forces open the consistency valve, and water is pumped by a water pump through the consistency valve into the hopper where the auger mixes it with the grout to reduce the viscosity of the grout.

When a user wishes to spread grout on a work surface, he or she must first turn off grout flow to the consistency valve. Then from a system hose, the user may withdraw pressurized grout. As grout pressure decreases in the system, the switch causes the auger to turn on and keep grout within the desired pressure range.

Grout Applicator Control Box and Tools

FIGS. 11–29 depict grout applicator control box and tools which may be used in conjunction with the grout slurry pumping system or separately as desired.

Figure 11:
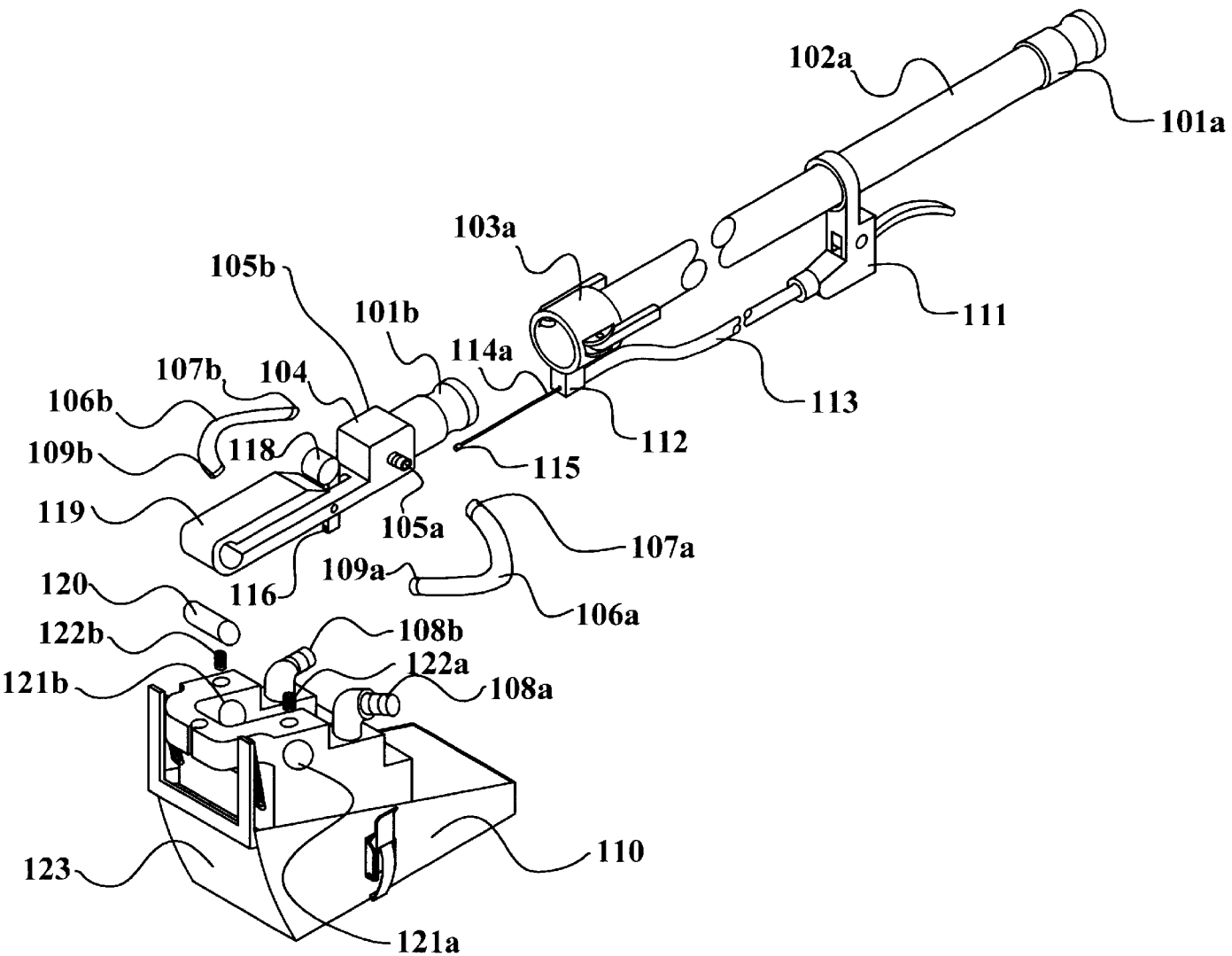
FIG. 11 depicts an embodiment of a joint applicator and control system of the inventions.

FIG. 11 depicts one embodiment of a joint compound applicator and control device of the inventions. Male cam and groove fitting 101*a* is threaded onto slurry pipe 102*a*. The pipe acts as a conduit for receiving grout from a pumping system and delivering it to an applicator control block such as 110. Slurry pipe 102*a* delivers joint compound to female cam and groove fitting 103*a*, which is threaded onto slurry pipe 102*a*. The fitting 103*a* may be connected by a user to a male fitting 101*b* which allows joint compound to flow to brake housing 104. Brake housing 104 has a cavity which creates a channel within it (not shown) through which joint compound is fed to hose barbs 105*a* and 105*b*.

Control box hoses 106*a* and 106*b* are connected to hose barbs 105*a* and 105*b* with hose clamps 107*a* and 107*b*. Joint compound is through control box hoses 106*a* and 106*b* to hose barbs 108*a* and 108*b*. The control box hoses 106*a* and 106*b* are connected to hose barbs 108*a* and 108*b* with hose clamps 109*a* and 109*b*, which are threaded into control block 110. The prior sequence of parts creates a channel through which joint compound is fed from male cam and groove-fitting 101*a* to control block 110.

A brake lever 111 (such as may be found on a bicycle) is mounted onto slurry pipe 102*a*. A brake cable housing 113 is connected to brake lever 111. Brake cable housing 113 is connected to cable holder 112, which holds brake cable housing in place when brake cable 114*a* is pulled. Cable stop 115 is connected to brake cable 114*a* and attaches to brake lever hole 116. Brake lever pin 117 connects brake arm 118 thus creating a pivot point for brake arm 118 when female cam and groove-fitting 103*a* is connected to male cam and groove fitting 101*b*. Cable stop 1115 is connected to brake lever hole 116. The brake lever 111 can then be squeezed by a user, thus pivoting brake arm 118, which puts pressure on brake 119 and thereby the locking brake housing with pin 120.

Pin 120 is shown disassembled from control block 110. Pin 120 is pressed into pin holes 121*a* and 121*b* and held in place with allen screws 122*a* and 122*b*. Brake housing 104 pivots with respect to control block 110. When a user squeezes brake lever 111, brake 119 is locked thus not allowing brake housing 104 and control block 110 to pivot. User uses this method to position control box 123 while holding slurry pipe 102*a*.

Figure 12:
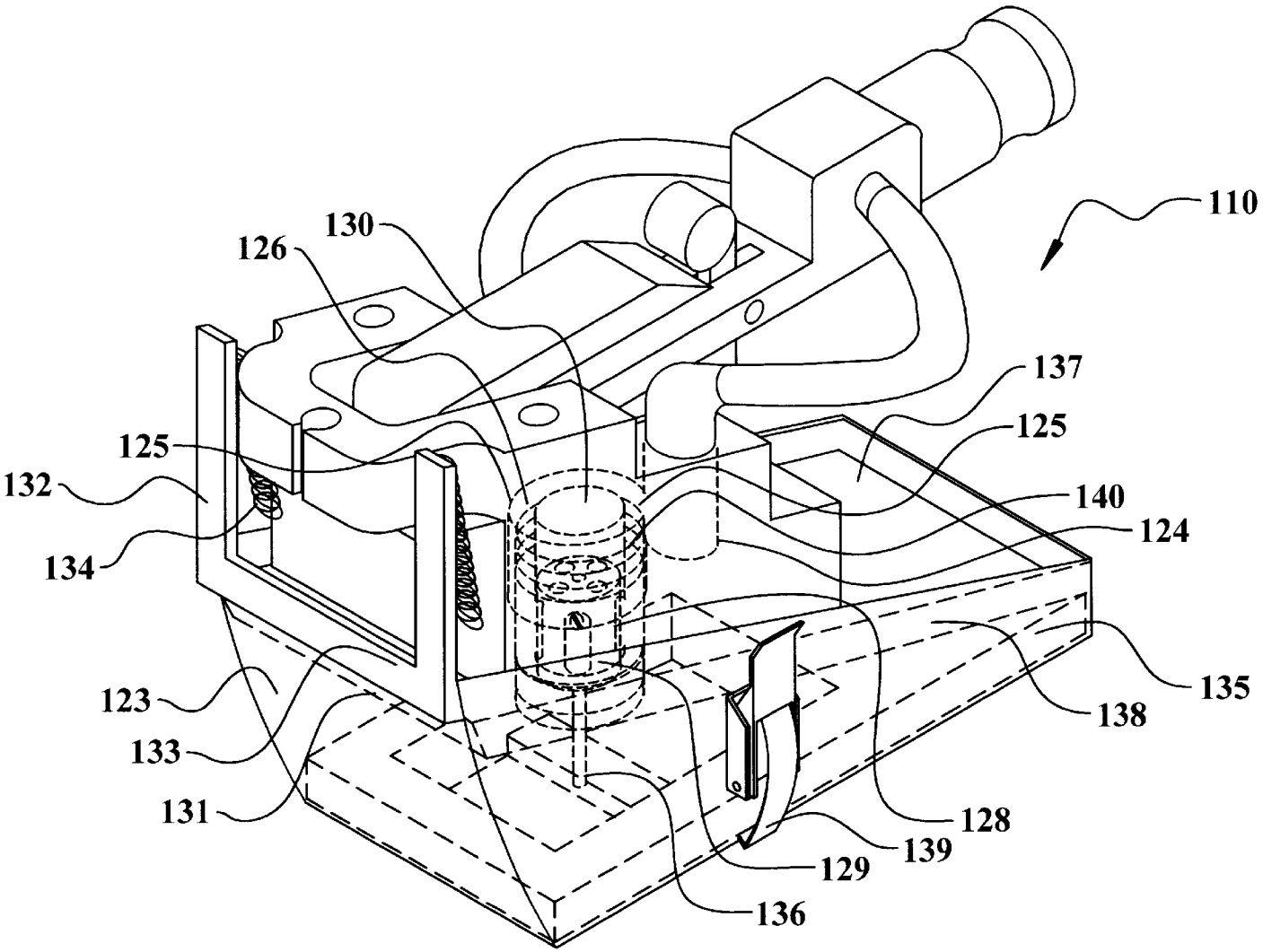
FIG. 12 depicts an embodiment of a control box of the inventions.

FIG. 12 depicts how control box 110 functions. Joint compound is fed through hose barb cavity 124 through connection hole 125 and fills cylinder housing cavity 126 which has only three openings. One opening is on bottom of the control box 110 where cylinder housing 140 is attached. The other two are on each side of cylinder housing cavity 126 that create connection hole 125.

As joint compound fills valve including cylinder-housing 140 it is forced into cylinder ports 128, where it remains until control block 110 is forced downward by a user pressing it against a work surface. When this happens, piston 129 (which is connected to tool mount 135 through cable mount 136) is forced upward towards cylinder 130. As this happens, joint compound is allowed to flow through cylinder ports 128 and into control box cavity 131.

When pressure is relieved from the control block 110, return spring 132 (which is connected to box spring mount 133) pulls on control block pin 134 which returns control block 110 to an upward position, thus stopping the flow of joint compound into control block cavity 131.

When joint compound is allowed to flow into control block housing cavity 131, the joint compound creates pressure inside control block cavity 131. When this happens, control box door 137 that is sealed by seal 138 travels upward. That action pulls cylinder 130 away from piston 129, blocking cylinder ports 128 stopping joint compound flow. Hasp 139 that is mounted to control box 123 is used to connect tools to control box 123.

Figures 13A, 13B, 13C:
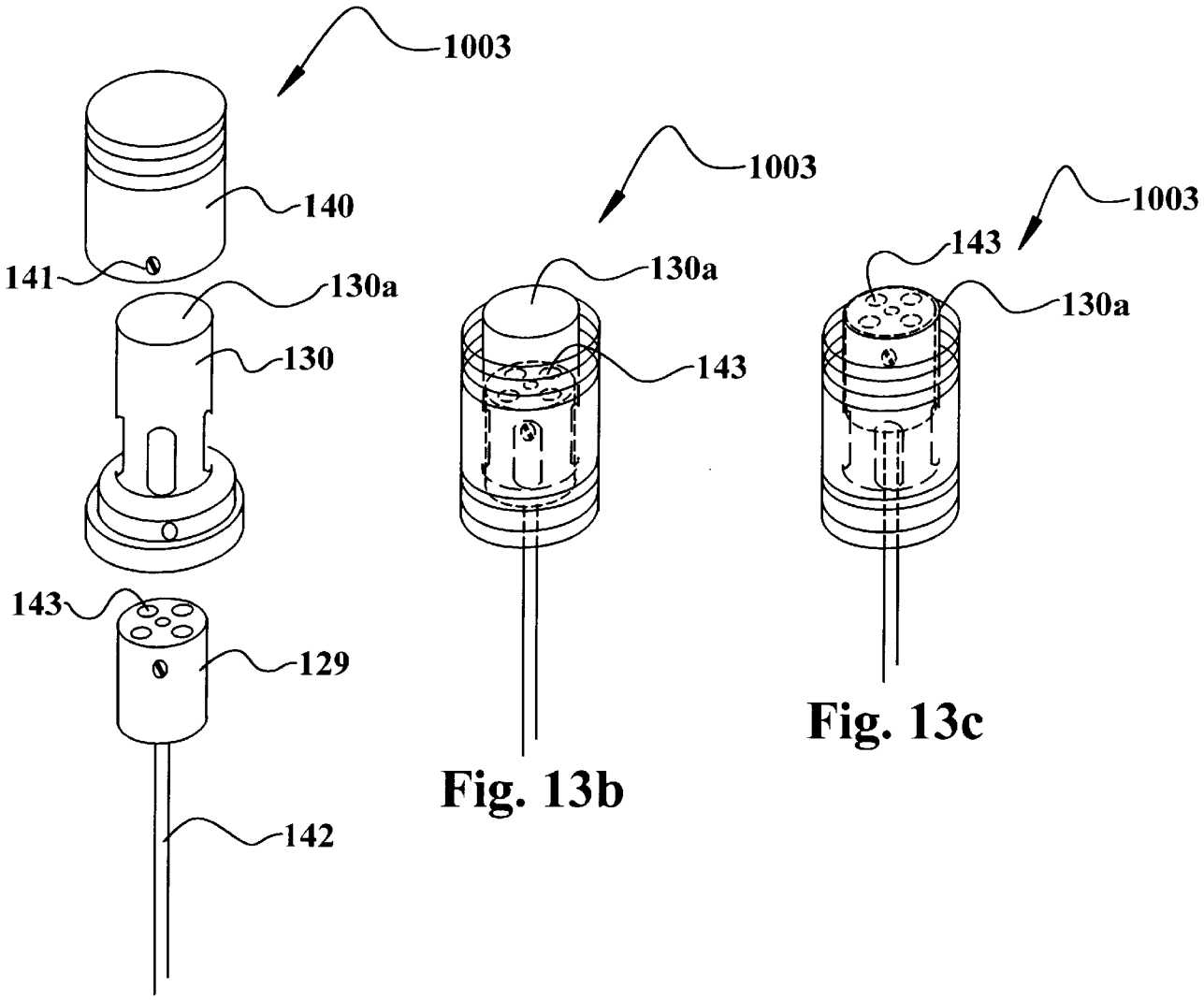
FIG. 13*a* depicts a parts explosion of an embodiment of a control box valve of the inventions.
FIG. 13*b* depicts the valve of FIG. 13*a* in its closed position.
FIG. 13*c* depicts the valve of FIG. 13*a* in its open position.

FIGS. 13*a*–13*c* depict the control box valve control box valve 1003. In FIG. 13*a,* the valve is disassembled. Cylinder housing 140 presses onto cylinder 130, which is secured by setscrew 141. Piston 129 is secured to cable 142. Piston ports 143 allow an escape of joint compound between piston 129 and top of cylinder 130*a,* but the solid portion of the piston 130 will retard flow of joint compound. FIG. 13*b* depicts the valve 1003 in it open position, and in FIG. 13*b* the valve 1003 is closed.

Figure 14A:
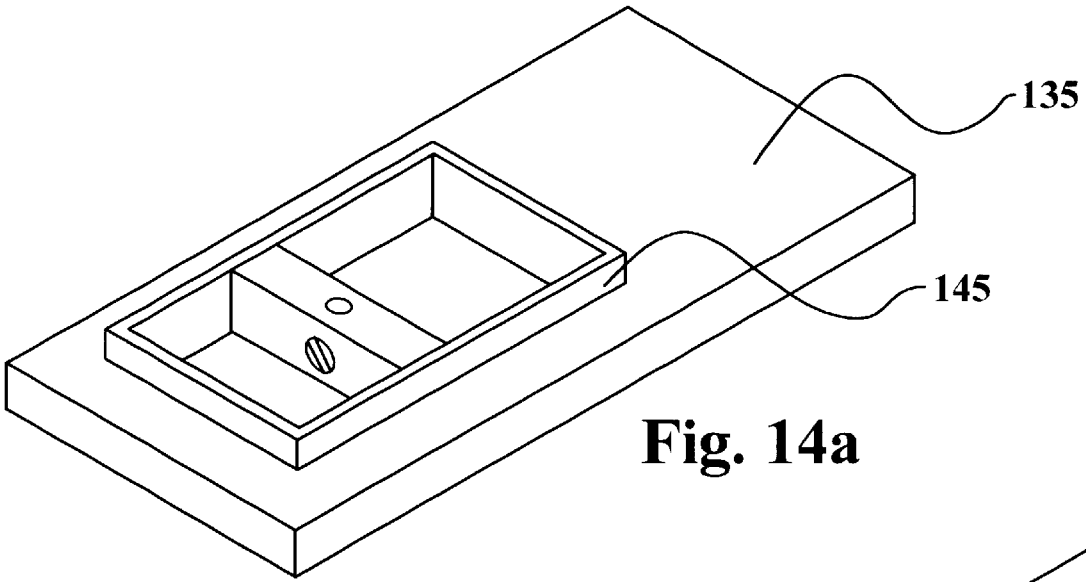
FIG. 14*a* depicts a bottom view of a tool mount of one embodiment of the inventions.
Figure 14B:
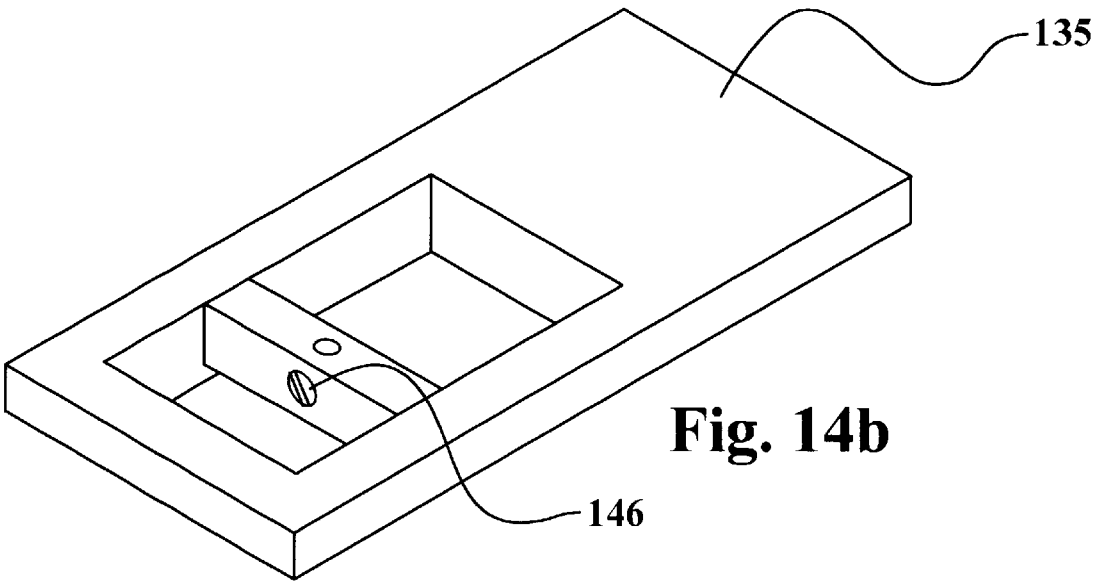
FIG. 14*b* depicts the bottom view of the tool mount of FIG. 14*a*.

FIGS. 14*a* and 14*b* depicts tool mount 135. FIG. 14*a* depicts a top view of the tool mount 135 and FIG. 14*b* depicts a bottom view. Control box mount view ledge 145 slips inside tools that can be attached in order to create a seal. Control box mount screw 146 holds cable 142 (not shown in this Figure).

Figure 15:
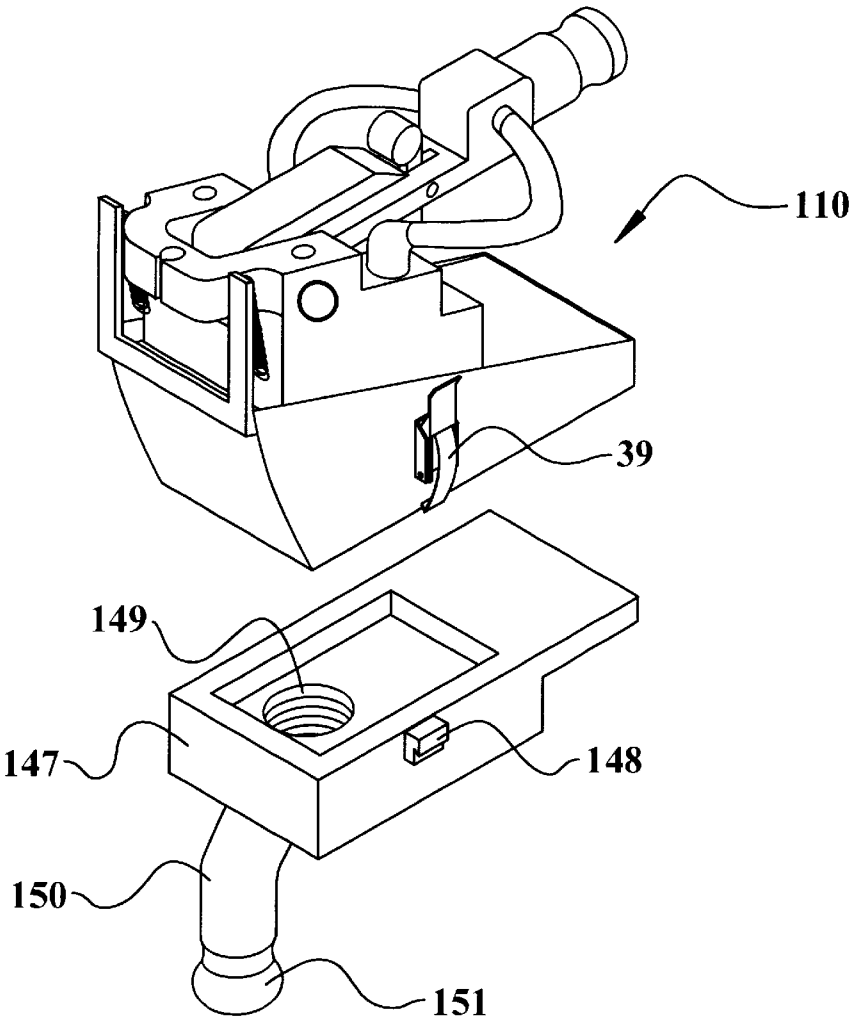
FIG. 15 depicts attachment of a control box to an angle box of one embodiment of the inventions.

FIG. 15 depicts attachment of the control box 110 to the angle box attachment 147. Angle box attachment 147 mounts to control box 110 with hasp 39. and hasp receiver 148. Joint compound flows through tube port 149 to tube 150 and then to tube ball 151. Angle heads and various other attachments already on the market can attached to tube ball 51.

Figure 16:
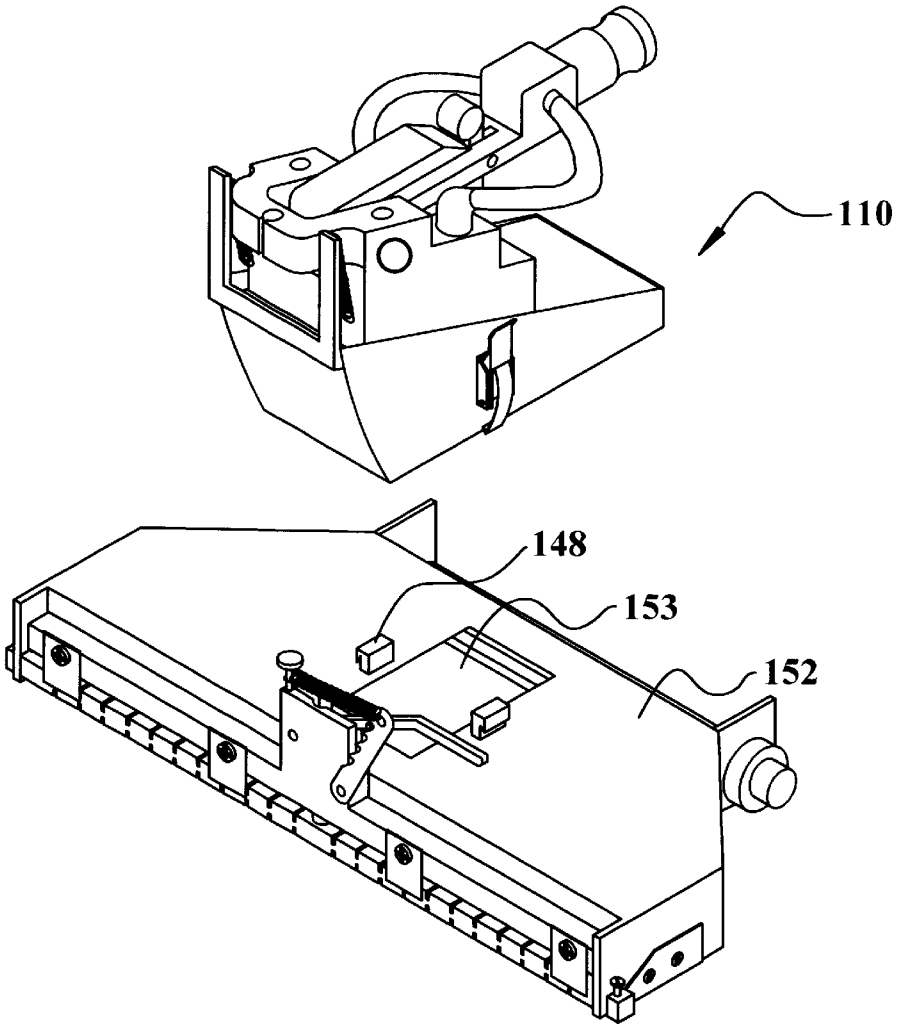
FIG. 16 depicts attachment of a control box to a joint box of one embodiment of the inventions.
Figure 17:
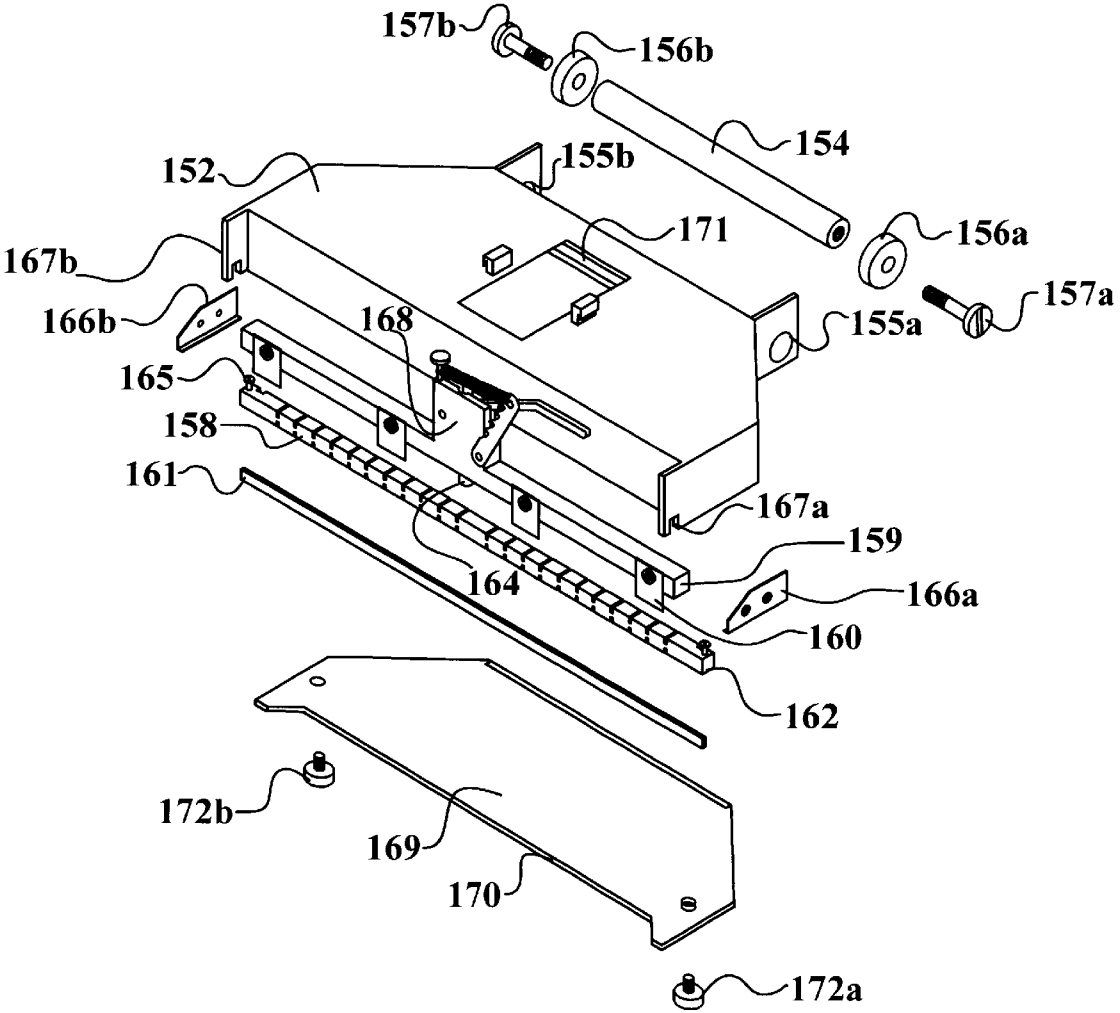
FIG. 17 depicts a parts explosion view of a joint box of one embodiment of the inventions.

FIG. 16 depicts control box 110 to joint box attachment 152. Control box 110 may be mounted to joint box 152 with hasp receiver 148. Joint compound flows from control box 110 through receiving hole 153 to the attachment 152.

FIG. 7 depicts joint box 152 in disassembled condition. Wheel rod 154 mounts to wheel rod mounts 155*a* and 155*b*. Wheels 156*a* and 156*b* mount to wheel rod 154 with screws 157*a* and 157*b*. Blade mount 159 mounts to joint box 152. Blade receiver glides 160 mount to blade mount 159. Blade receiver 158 is allowed to flex between blade receiver glides 160 and joint box 152. Blade 161 mounts in blade receiver slot 162. Depth of blade 161 by adjustment screw 165. Blade receiver 158 is connected to slots 167*a* and 167*b* by shoes 166*a* and 166*b*. Arch of blade 161 is adjusted by blade adjuster 168 which puts pressure on adjuster pin 164 which pushes on blade receiver 158 which arches blade 161.

The foregoing structures permit the coating sheetrock joints with a preset amount of joint compound. Joint box flap 169 mounts to joint box 152 by slipping joint box flap 169 into flap slot 171. This creates a convenient way for the user to clean joint box 152. Joint flap 169 is held in place by screws 172*a* and 172*b*. Joint compound flows through joint box 152 and out of coating slot 170.

Figure 18A:
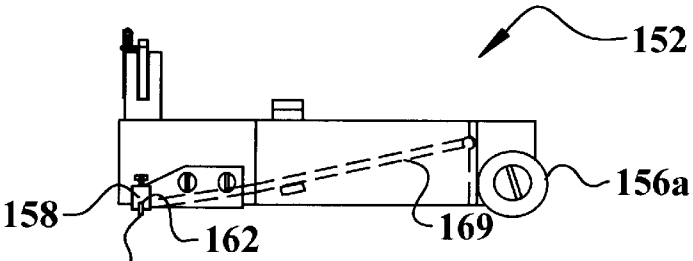
FIG. 18*a* depicts a side view of a joint box of one embodiment of the inventions.
Figure 18B:
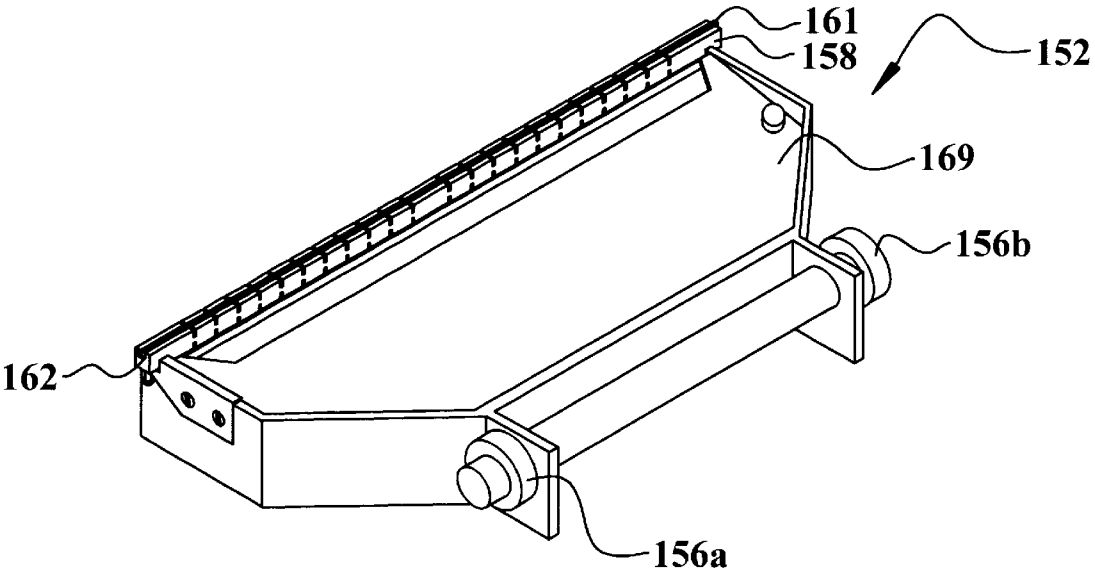
FIG. 18*b* depicts a perspective view of the underside of the joint box of FIG. 18*a*.

FIGS. 18*a* and 18*b* depict a side and bottom view, respectively, of joint box 152. These views show joint box flap 169 installed in the box 152.

Figure 19:
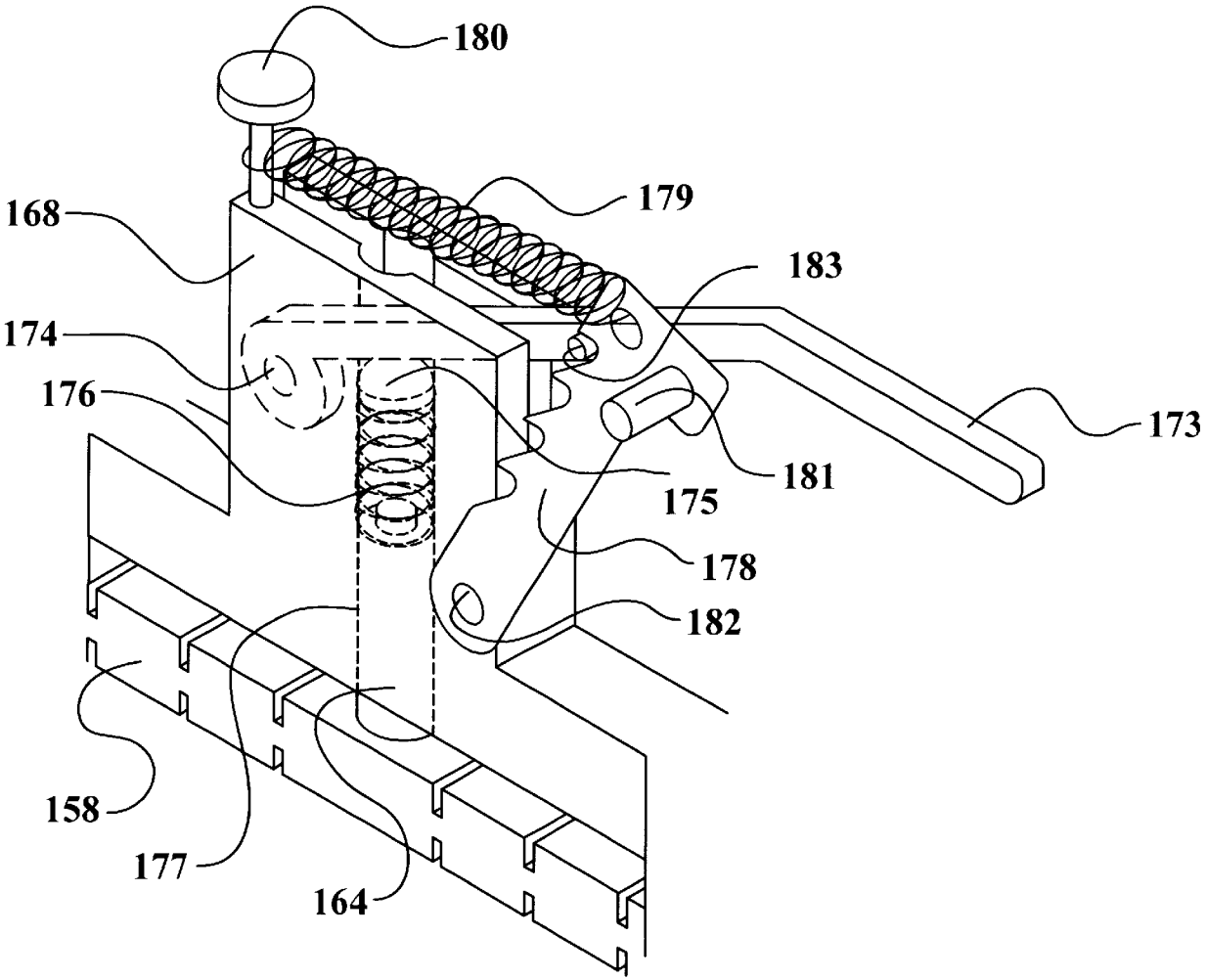
FIG. 19 depicts a mechanism for adjusting blade height of an applicator blade of one embodiment of the inventions.

FIG. 19 depicts blade adjuster operation. Adjuster lever 173 pivots on pin 174. This pivot action allows a user to put pressure on spring ball 175. When spring ball 175 is forced downward, spring 176 is compressed thus putting pressure on adjuster pin 177, which in turn puts pressure on blade receiver 158. As adjuster lever 173 is pushed downward, lever lock 178 pulls against adjuster lever pin 183 due to tension from spring 179, which is attached to blade adjuster 168 by spring pin 180. Lever lock 178 holds adjuster lever 173 in place until a user pulls lever lock handle 181 away from lever pin 182, thus allowing adjuster lever to be moved to a new position.

Figure 20:
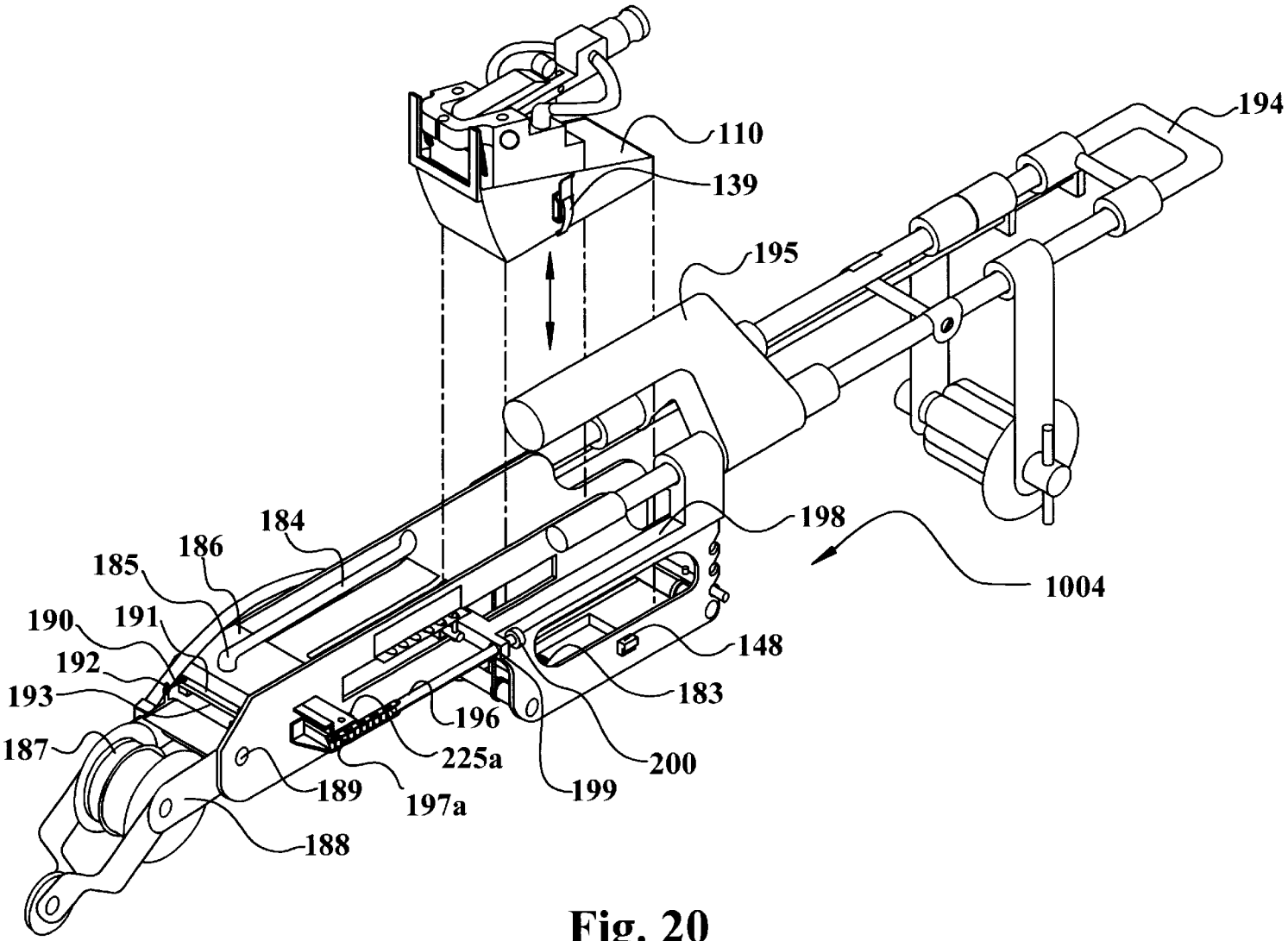
FIG. 20 depicts an automatic taper for drywall with a control box exploded from it.

FIG. 20 depicts attachment of a control box 110 to an automatic taper attachment 1004. Control box 110 attaches to automatic taper 1004 with hasp 139 and hasp receiver 148. With control box 110 installed and control box door tension set (refer to FIG. 11), joint compound can then flow from control box 110 through gate inlet 183 through gate tube 184 (also shown in FIG. 22) and into gate port 185. Joint compound is then held in joint compound gate valve 186 until a user pushes tape grip wheel 187 against a work surface. When a user does this, grip wheel arm 188 pivots on pin 189. This causes cable receiver 192 to rotate and pulls on gate cable 190, thus pulling gate 191 which opens the flow of joint compound where it is then applied to tape through joint compound applicator 193.

A user operates the automatic taper by griping roller grip 194 with one hand and feeder/cutter grip 195 with the other hand. The user can then feed tape by pushing feeder/cutter grip 195 forward. As feeder/cutter grip 195 is pushed forward, feeder arm 198, which is attached to feeder/cutter grip 195, also moves feeding tape forward (also see FIG. 24). When a user pulls back on feeder/cutter grip 195, cutter rod 196 slides through feeder arm hole 199 and catches on cutter rod stop 200, which pulls cutter chain 197*a* (shown and explained in FIG. 23). However when feeder arm 198 is pushed forward, cutter rod 196 slides through feeder arm hole 199, leaving cutter operations unaffected.

Figure 21:
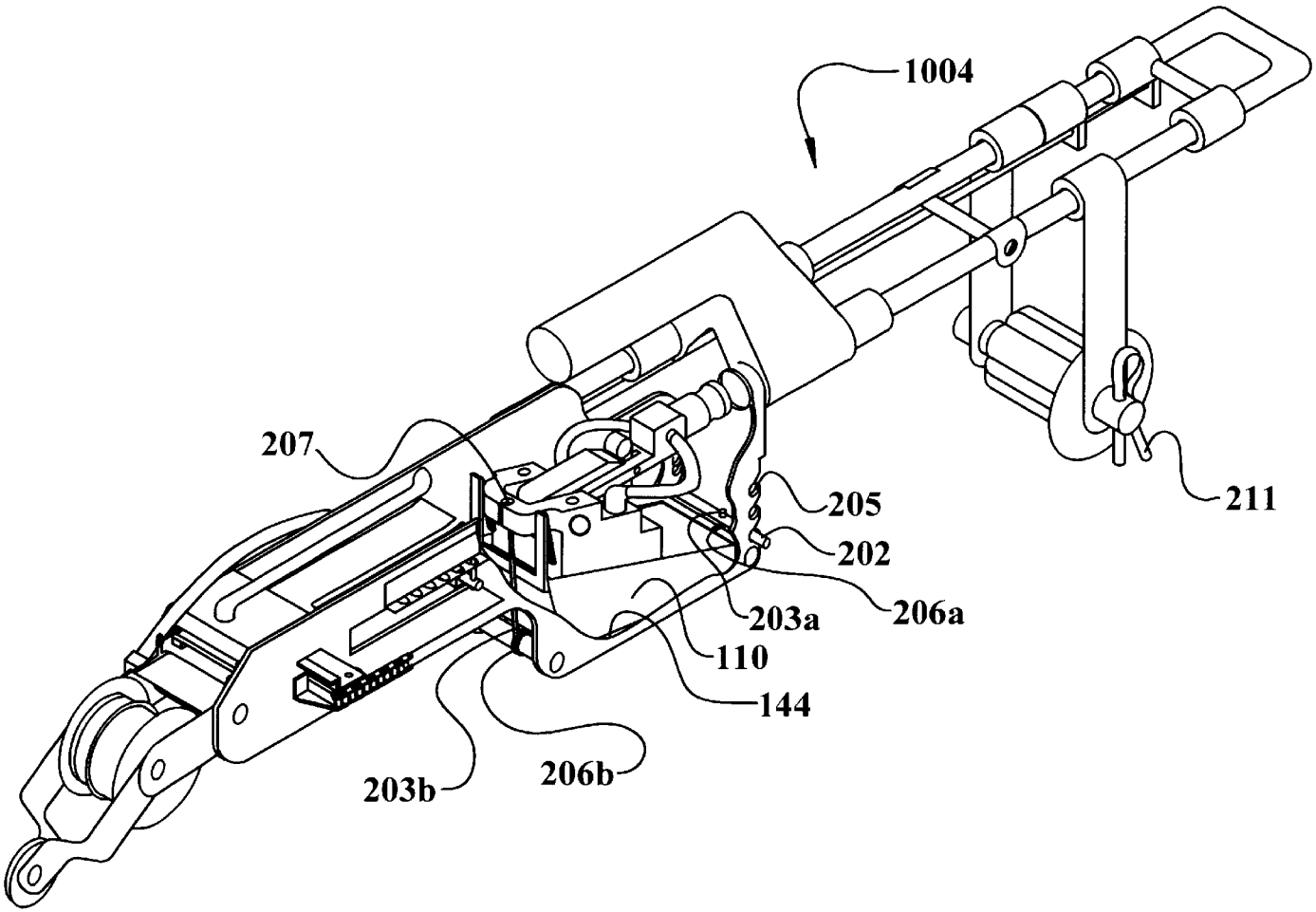
FIG. 21 depicts an automatic taper in cut-away view so that the control box may be seen inside of it.
Figure 25:
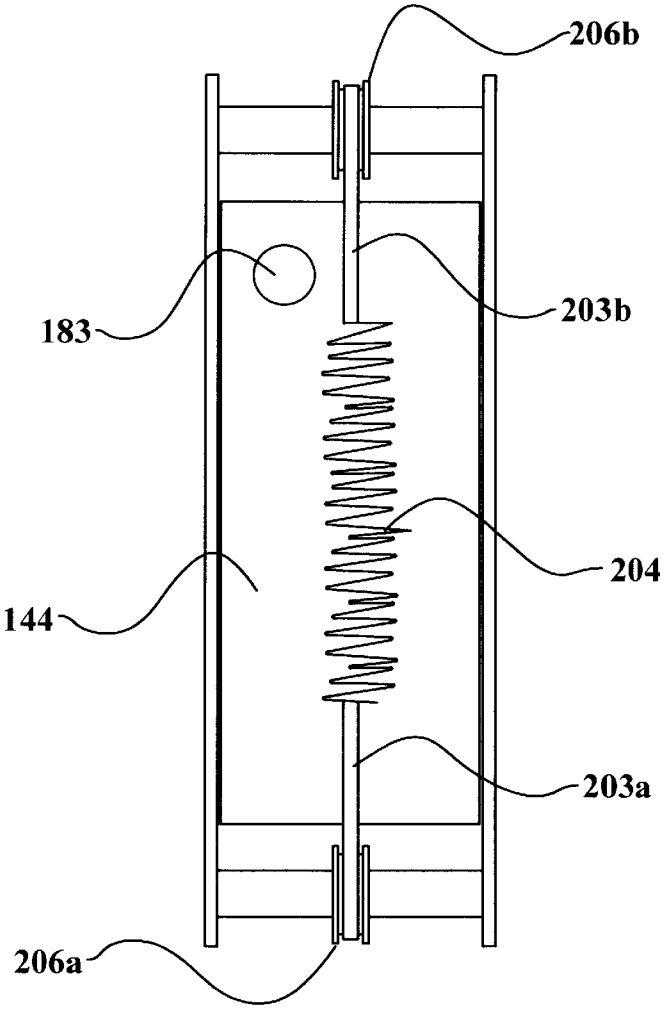
FIG. 25 depicts control box tension system for use with an automatic taper.

FIG. 21 depicts a cut-away view of a control box 110 attached to an automatic taper 1004. Tool mount 135 (FIGS. 12, 14*a* & 14*b*) slips into automatic taper mount 144. Tool mount ledge 145 (FIG. 14*a*) fits into automatic taper mount receiver 201 (FIG. 26) thus creating a seal. A user can set control box tension by pulling up on tension pin 202 thus pulling tension cable 206*a* around tension cable wheel 206*b* (also shown in FIG. 25). When this happens, tension spring 104 (FIG. 25) expands creating a desired amount of tension on tension cable 203*b*. Cable stop 203*a* holds the cable in place. As this is happening, tension cable 203*b* is pulled around tension wheels 206*a* and 206*b* (FIG. 25) that are connected to control block cable receiver 207. Due to tension on tension cable 203*b,* control block 110 is pulled downward putting desired pressure on control block door 137 (FIG. 12), which allows control box 110 to operate in manner described above. Tension pin 202 can be removed and reinserted into tension pin slots 205 by the user. The tension pin 202 is held in place by tension created by tension spring 204 (FIG. 25). Tension is increased by moving the tension pin 202 to higher tension pin slots 205, and it is decreased by moving the tension pin 202 to lower tension pin slots.

Figure 22:
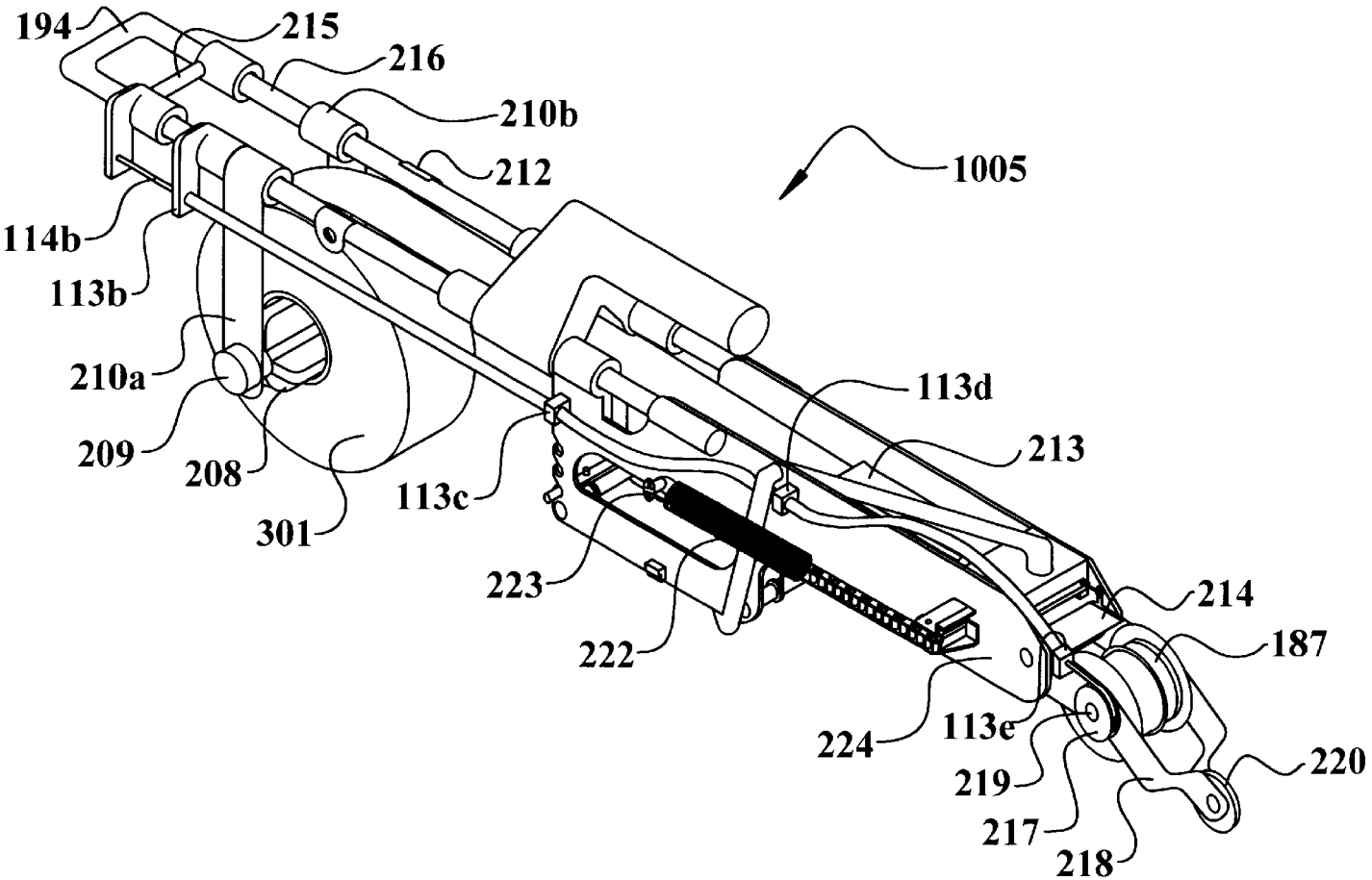
FIG. 22 depicts an automatic taper.

FIG. 22 depicts an automatic taper 1005 with a roll of perfatape 301 installed. Essentially, this figure depicts the opposite side of the taper from FIG. 21. Perfatape 301 is installed on tape roller 208 by first removing secure pin 211 (FIG. 21), and then pulling tape roller pin 209 from tape roller holder 210*a,* and removing tape roller 208 and tape roller holder 210*b*. Perfatape 301 is reinstalled by inserting tape roller 208 into perfatape roll 301, then repositioning tape roller 208 in its original position, and inserting roller pin 209 through tape roller holder 210*a,* tape roller 208, and tape roller holder 210*b*. Secure pin 211 must also be reinstalled into tape roller pin.

Perfatape 301 is then allowed to spin on tape roller 208. Perfatape can then be pulled over tape catch 212, which keeps perfatape in its proper position. Tape is then inserted into tape slide 213 and fed to tape bridge 214, which ensures that tape extends to tape grip wheel 187 (see also FIG. 20). As user holding onto roller grip 194 can grip tape press lever 215 with a desired finger or fingers. When the user pulls tape press lever 215, it slides on frame tube 216. When this happens brake cable 114*b* is pulled through brake cable housing 113*b,* which is secured as described above. The brake cable then pulls tape press pulley 217 which is secured to tape press flipper 218, thus pivoting tape press flipper 218 on roll pin 219. This presses crease roller 220 against the center of the perfatape. This method is used to crease perfatape into angles and give user more control of perfatape.

Cable mounts 113*b,* 113*c,* 113*d* and 113*e* keep the cable in position. Spring mount 222 keeps chain tension spring 222 taught in order to keep tension on the chain.

Figure 23:
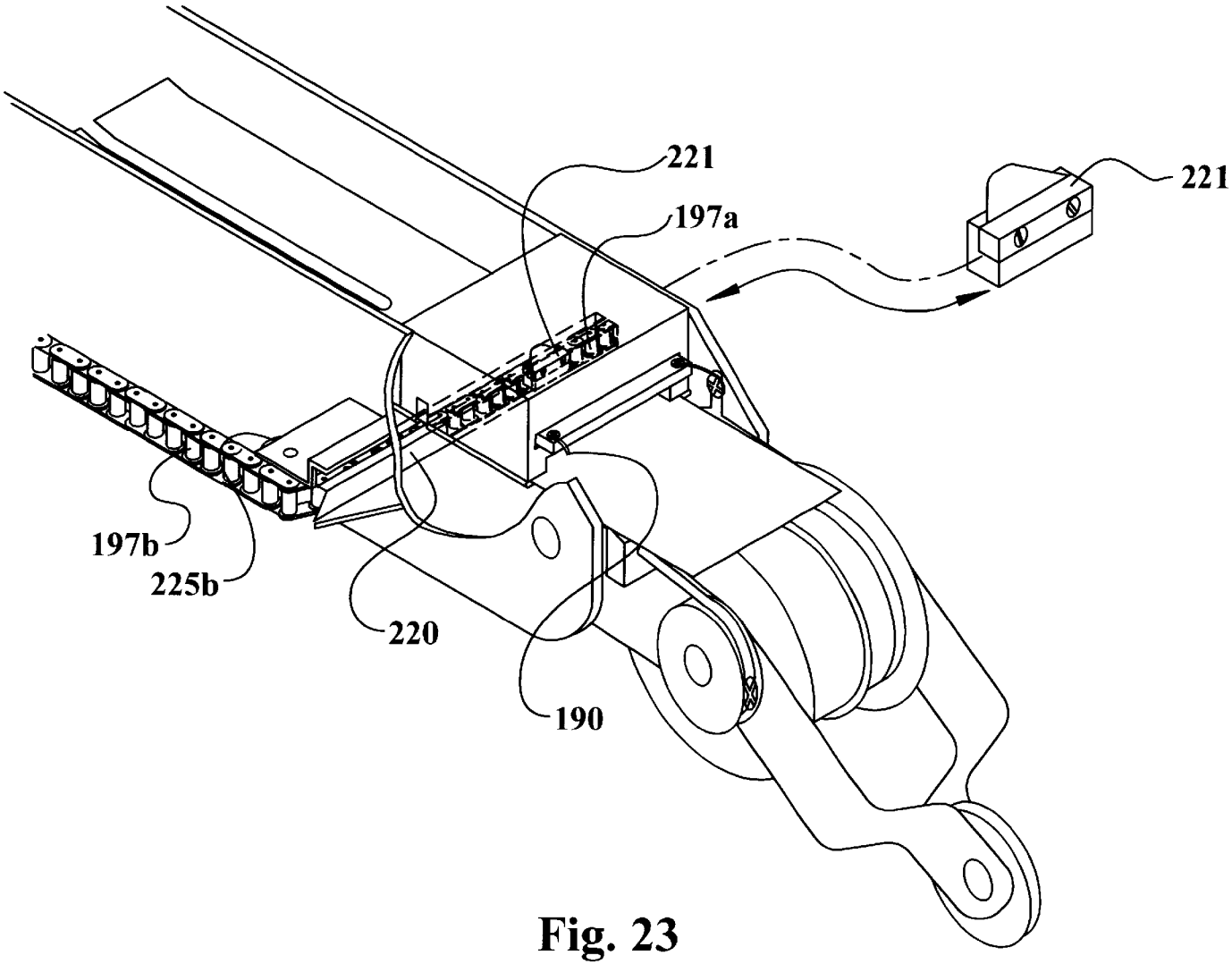
FIG. 23 depicts a cut-away view showing a tape cutter and joint compound gate.

FIG. 23 is a cutaway partially exploded view showing a tape cutter and joint compound gate. When cutter chain 197*a* (FIG. 10) is pulled across chain roller 225*b,* cutter blade 221 being attached to the chain, slides through cutter blade channel 220 slicing the perfatape. Cutter chain 197*b* is attached to cutter blade 221 and return spring 222 (FIG. 22). When a user releases feeder/cutter grip 195 (shown in FIG. 10), cutter chain 197*b* is pulled by return spring 222 across chain roller 225*b* thereby returning cutter blade 221 to a ready position.

Figures 24, 24A, 24B:
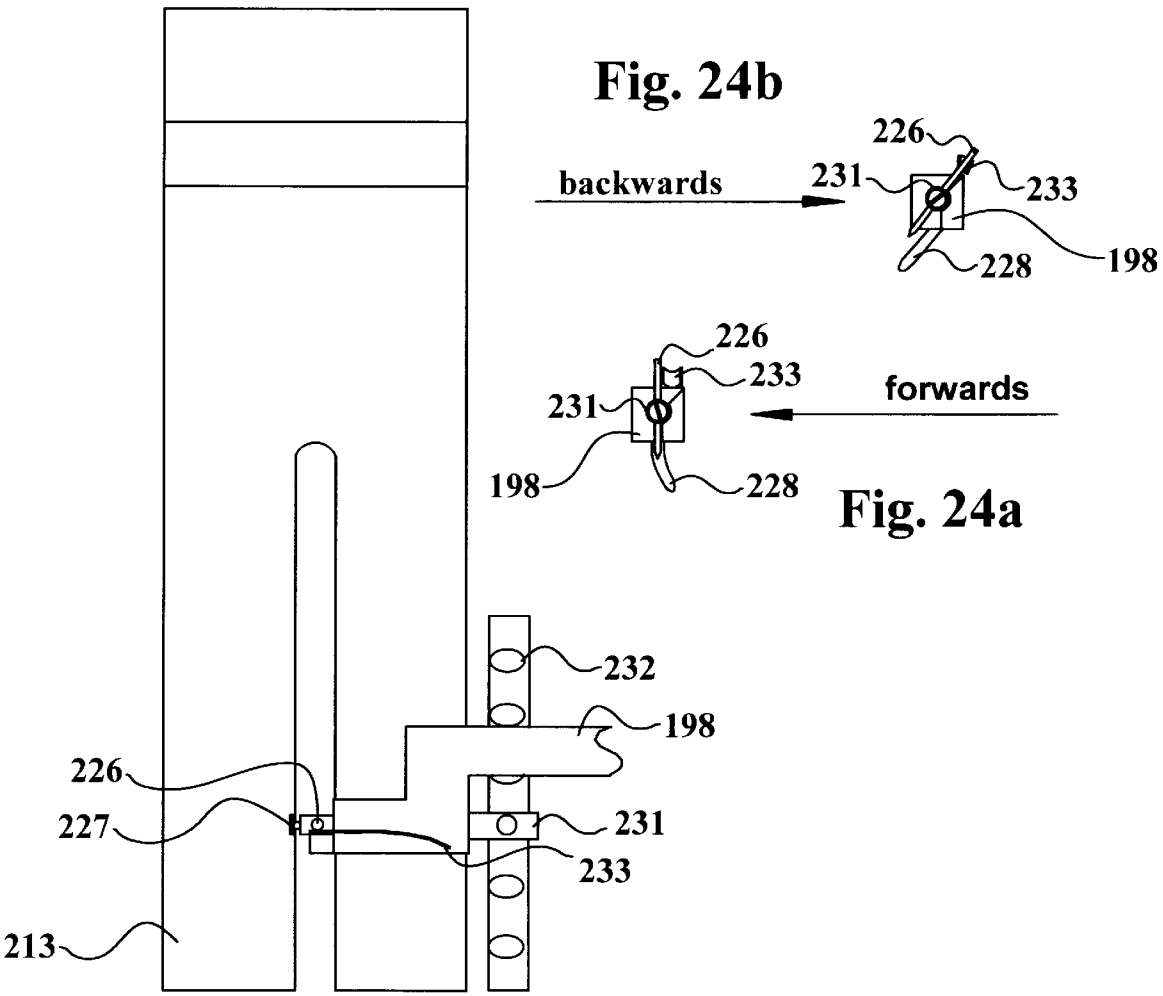
FIG. 24 depicts the underside of an automatic taper.
FIGS. 24*a* and 24*b* depict an acuator assembly of the taper of FIG. 24.

FIG. 24 depicts the underside of a tape slide over which perfatape is fed. A user forces perfatape into tape slide 213, and past feeder needle 226 (which is secured into pivot rod 231 by needle screw 227). Feeder needle 226 is forced into a vertical position due to pressure from needle spring 233, which is secured to feeder arm 198. As feeder arm 198 is pushed forward, feeder needle 226 penetrates perfatape forcing it forward. When this happens, rubber finger 228 drags along finger catch 232 not affecting feeder operations. When feeder arm 198 is pulled backwards, rubber finger 228 falls into finger catch 232 forcing feeder needle 126 into a semi horizontal position and pulling feeder needle 226 out of the perfatape. Rubber finger 228 then slides along finger catch 232 in a backward position, thus keeping feeder needle 226 in a backward position, and allowing feeder needle 226 to glide over perfatape without pulling it out of position.

FIGS. 24*a* and 24*b* depict feeder needle 226, needle spring 233, pin rod 231, feeder arm 198 and rubber hinge 228 in the forwards and backwards positions, respectively.

FIG. 25 depicts the underside of an automatic taper mount 144, showing the control box 110 tension system. The control box 110 tension components that were previously described with respect to FIG. 21 are shown.

Figure 26A:
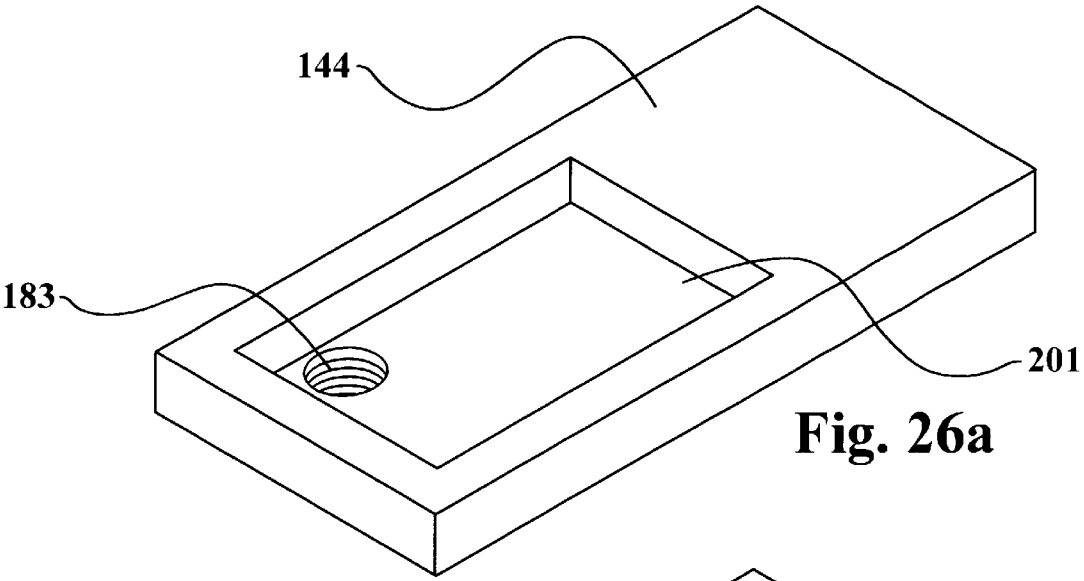
FIG. 26*a* depicts a top view of an automatic taper mount.
Figure 26B:
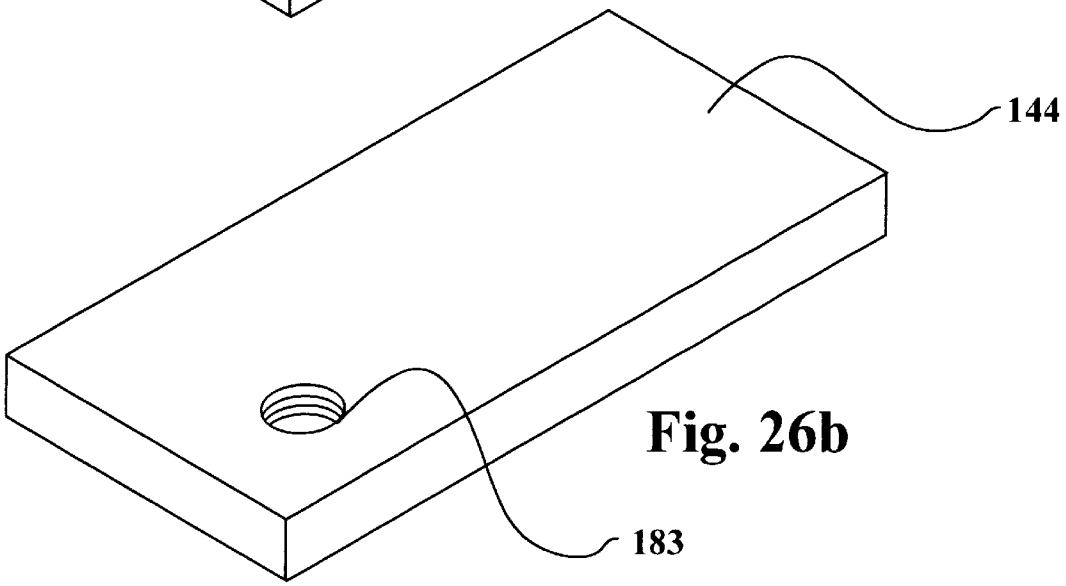
FIG. 26*b* depicts a bottom view of an automatic taper mount.

FIG. 26*a* depicts the top of an automatic taper mount, and FIG. 26*b* depicts the bottom of the same. Shown are automatic taper mount 144, gate inlet 183, and automatic taper mount receiver 201.

Figure 27:
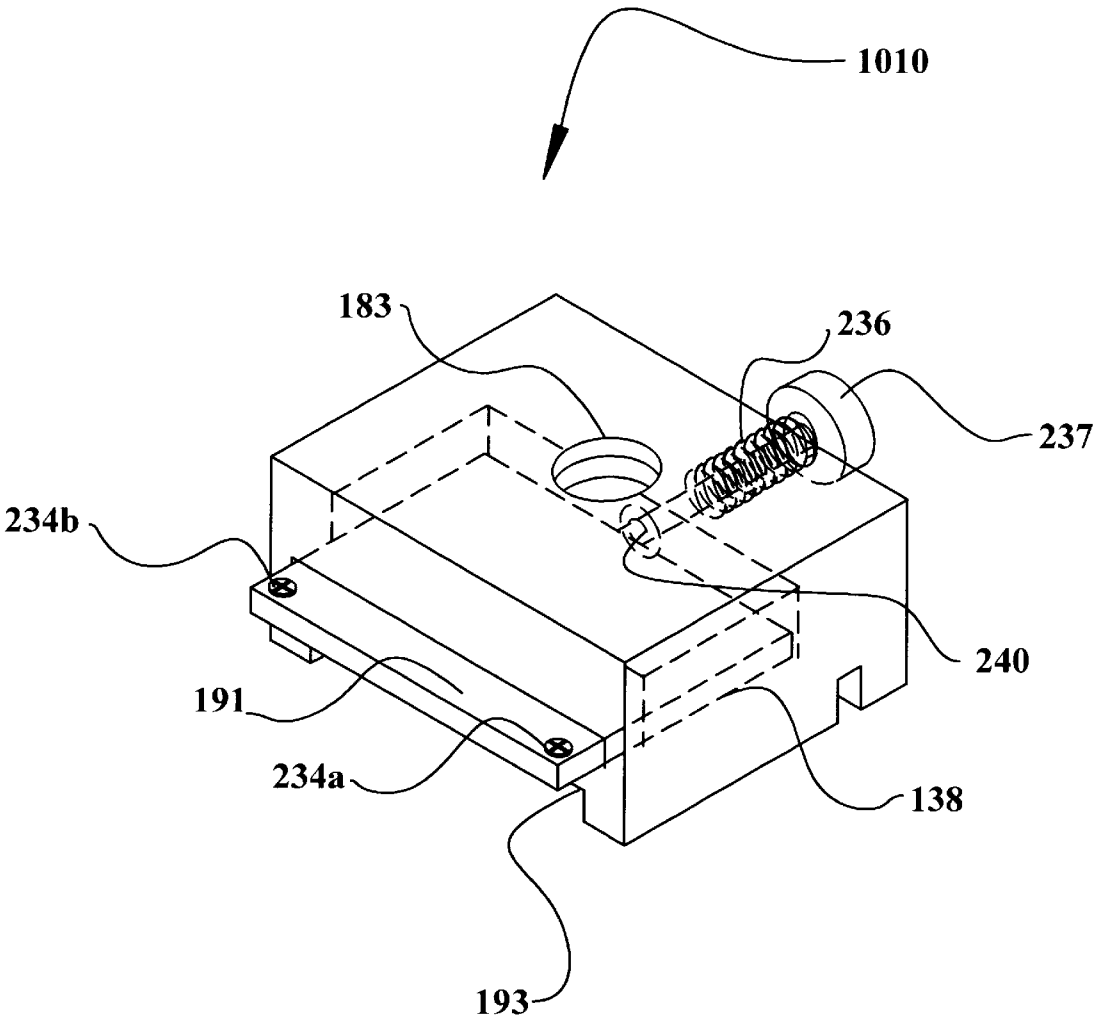
FIG. 27 depicts a joint gate valve of an embodiment of the inventions in closed position.

FIG. 27 depicts a joint compound gate valve 1010 in its closed position. When gate 191 is pulled by gate cable 190 (FIG. 23) (which is attached by gate cable screws 234*a* and 234*b*) gate 191 slides on gate ledge 138, which opens a channel 183 through which joint compound can flow. Joint compound then flows from gate inlet 183 to joint compound applicator 193. When gate 191 is in an open position, spring stop 237 pushes against gate spring 236. When gate cable 90 is released, pressure from gate spring 136 pulls gate 191 shut. Gasket 240 (FIG. 29) prevents leakage.

Figure 28:
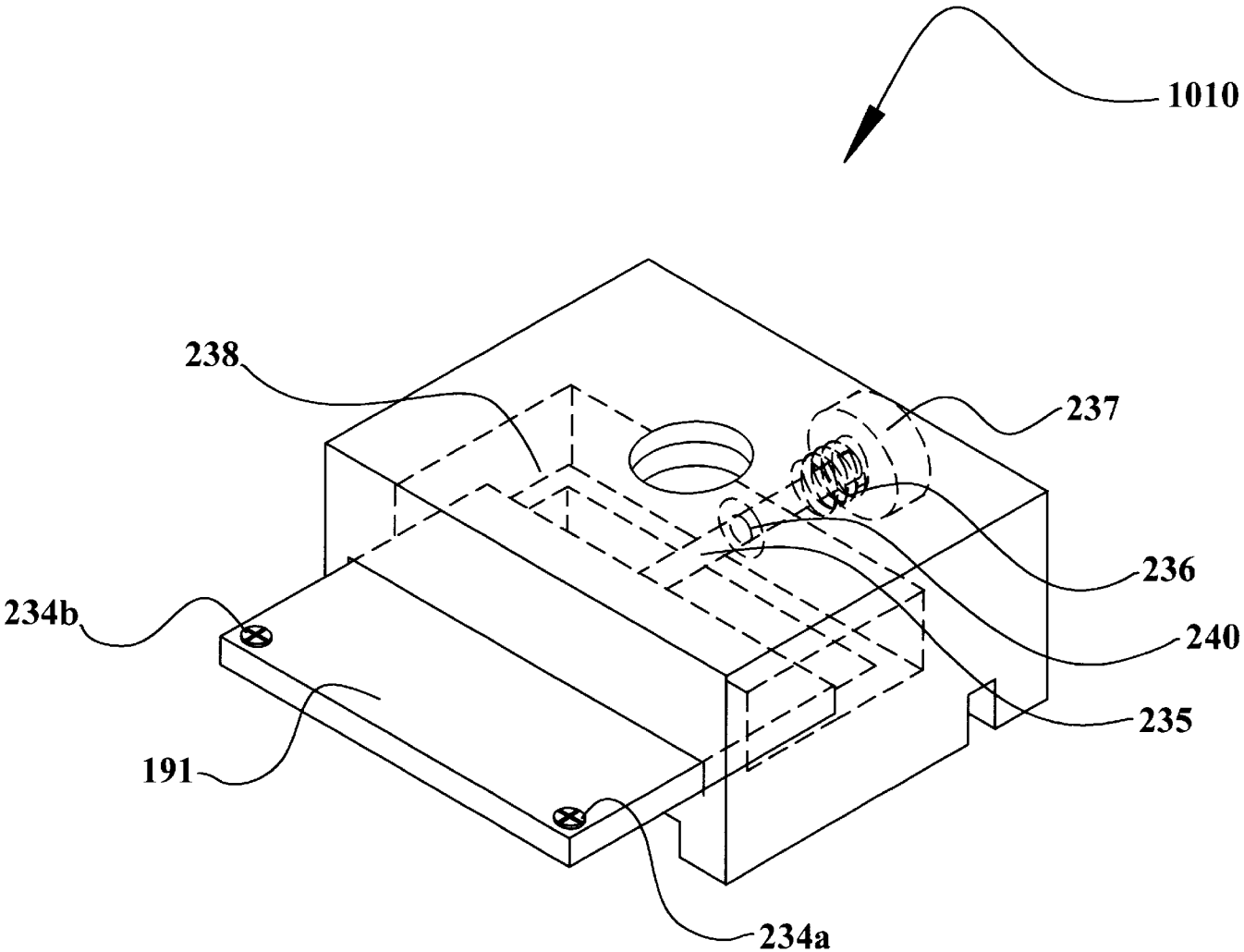
FIG. 28 depicts the valve of FIG. 27 in open position.

FIG. 28 depicts the joint compound gate valve of FIG. 27 in an open position.

Figure 29:
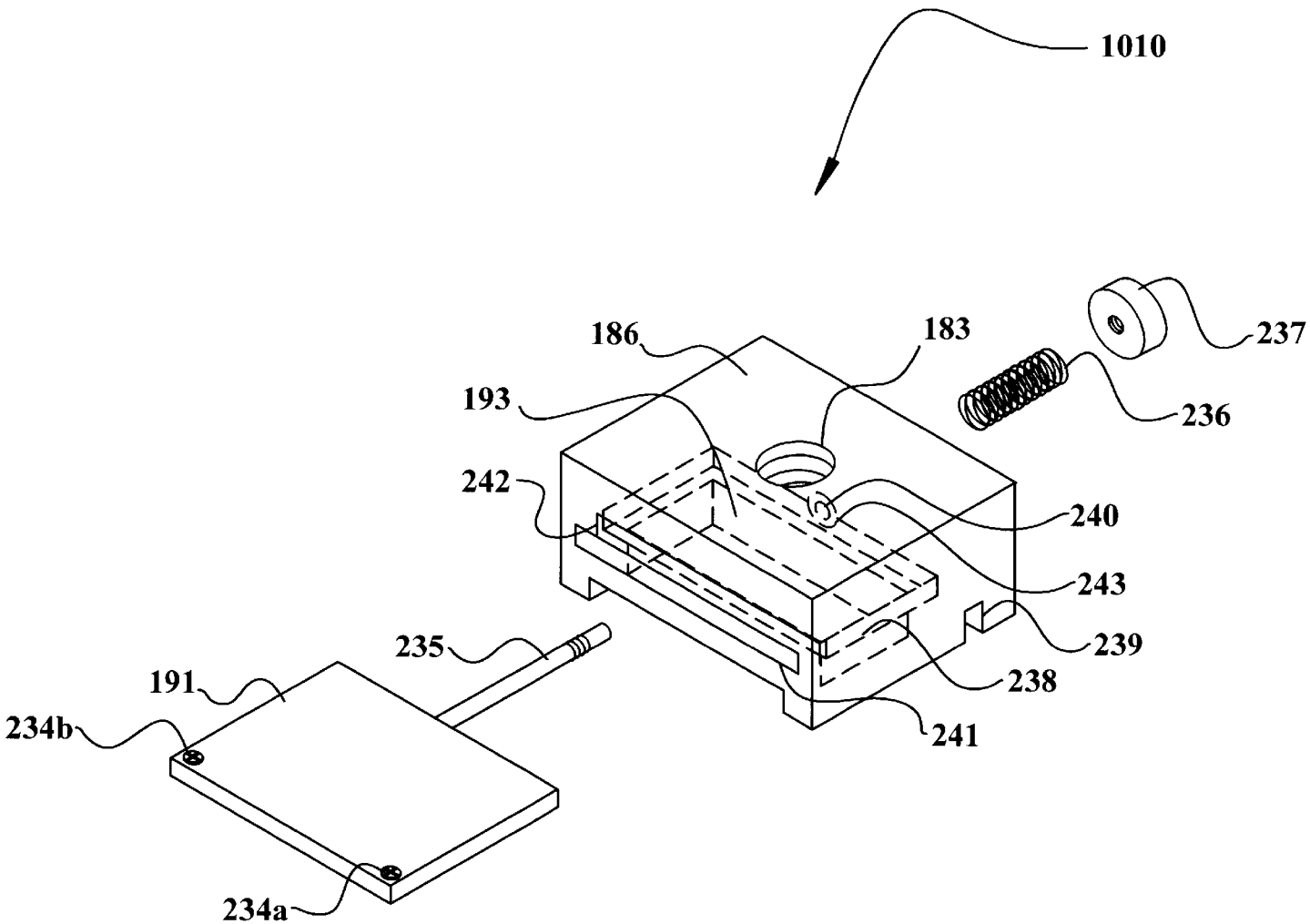
FIG. 29 depicts a parts explosion view of the valve of FIG. 27.

FIG. 29 depicts a parts explosion view of joint compound gate valve 1010 disassembled. To reassemble, push gate 191 and attached gate rod 235 through gate slot 241. Gate rod 235 slides through gate rod hole 240 and out the back side of joint compound valve 186. Then gate spring 236 can slide over gate rod 235 and be retained by spring stop 237. Blade slot 239 is provided as a channel through which cutter blade (not shown) can slide. Gate seal 242 and rod seal 243 ensure that joint compound does not leak around gate 191 and gate rod 135.

When a user desires to utilize the control box and tools to apply mud to a work surface, the following scenario is followed. Pressurized grout is made available to the control box. Within the control box, the pressurized grout fills the voids and receptacles. The piston of the control box valve will keep the valve ports closed and prevent mud from leaving the control box. When the user presses the control box and a tool attached to it against a work surface, the piston of the control box valve travels up in its bore exposing the valve ports, and permitting grout to travel out of the valve to the tool and to a work surface. The piston may be caused to travel up in the bore in variable positions depending on how much pressure the user exerts on the control box, thus controlling volume of grout flow. As grout flows out of the control box to the tool, pressure of the pressurized grout will drop, and if connected to pump system of the invention, the pump and auger will operate to increase grout pressure again, maintaining grout pressure within a useful pressure range.

The disclosures of U.S. Provisional Patent Application Ser. No. 60/156,763 filed on Sep. 29, 1999, and U.S. Provisional Patent Application Ser. No. 60/187,740 filed on Mar. 8, 2000 are hereby incorporated by reference.

While the present inventions have been described and illustrated in conjunction with a number of specific embodiments, those skilled in the art will appreciate that variations and modifications may be made without departing from the principles of the inventions as herein illustrated, described and claimed.

The present inventions may be embodied in other specific forms without departing from their spirit or characteristics. The described embodiments are to be considered in all respects as only illustrative, and not restrictive. The scope of the inventions are, therefore, indicated by the appended claims, rather than the foregoing description. All changes which come within the meaning and range of equivalency of the claims are to be embraced within their scope.

What is claimed is:

1. A grout pumping system comprising:

a grout hopper, a grout pump capable of pumping grout, a grout pipe connecting said hopper with said pump in order to supply said pump with grout from said hopper, a turbine having a shaft, a grout pipe connecting said grout pump with said turbine, and an auger on said turbine shaft, said auger being located in said hopper.

2. A system as recited in claim 1 wherein pumping of grout by said grout pump forces grout through said turbine thereby turning said turbine shaft, said turning of said turbine shaft in turning said auger, and turning of said auger forcing grout to said pump.

3. A system as recited in claim 2 further comprising a pressure sensitive switch.

4. A system as recited in claim 3 wherein said switch has a high pressure setting and a low pressure setting.

5. A system as recited in claim 4 wherein said switch acts to keep grout in the system pressurized within a desired pressure range.

6. A system as recited in claim 2 further comprising a consistency valve.

7. A system as recited in claim 2 wherein said consistency valve is openable to permit water to enter said hopper and reduce grout viscosity.

8. A system as recited in claim 2 further comprising:

a water tank, a consistency valve in fluid communication with said water tank, a grout pipe supplying pressurized grout to said consistency valve, a consistency valve outlet leading to said hopper;

wherein when grout within the system becomes sufficiently viscous, it forces said consistency valve open, allowing water to flow from said consistency valve to said hopper, thereby reducing grout viscosity.

9. A system as recited in claim 8 further comprising a water pump which provides pressurized water from said water tank to said consistency valve.

10. A system as recited in claim 2 further comprising a system hose which maybe used to remove pressurized grout from the system.

11. A system as recited in claim 8 further comprising a system hose which maybe used to remove pressurized grout from the system.

12. A grout pumping system comprising:

a grout hopper, a grout pump capable of pumping grout, a grout pipe connecting said hopper with said pump in order to supply said pump with grout from said hopper, a turbine having a shaft, a grout pipe connecting said grout pump with said turbine, an auger on said turbine shaft, said auger being located in said hopper, a pressure switch which switches said grout pump on when grout pressure reaches a predetermined low level, and which switches said grout pump off when grout pressure reaches a predetermined high level, a consistency valve in fluid communication with a water source, a grout pipe supplying pressurized grout to said consistency valve, and a consistency valve outlet leading to said hopper;

wherein when grout within the system becomes sufficiently viscous, it forces said consistency valve open, allowing water to flow from said consistency valve to said hopper, thereby reducing grout viscosity; and wherein pumping of grout by said grout pump forces grout through said turbine thereby turning said turbine shaft, said turning of said turbine shaft in turning said auger, and turning of said auger forcing grout to said pump.

13. A grout pumping system comprising:

a grout hopper, a grout pump capable of pumping grout, a grout pipe connecting said hopper with said pump in order to supply said pump with grout from said hopper, an auger located in said hopper and being capable of mixing grout in said hopper, and a pressure switch which switches said grout pump on when grout pressure reaches a predetermined low level, and which switches said grout pump off when grout pressure reaches a predetermined high level.

14. A system as recited in claim 13 further comprising:

a consistency valve in fluid communication with a water source, a grout pipe supplying pressurized grout to said consistency valve, and a consistency valve outlet leading to said hopper;

wherein when grout within the system becomes sufficiently viscous, it forces said consistency valve open, allowing water to flow from said consistency valve to said hopper, thereby reducing grout viscosity.

15. A grout pumping system comprising:

a grout hopper, a grout pump capable of pumping grout, a grout pipe connecting said hopper with said pump in order to supply said pump with grout from said hopper, an auger located in said hopper and being capable of mixing grout in said hopper, a pressure switch which switches said grout pump on when grout pressure reaches a predetermined low level, and which switches said group pump off when grout pressure reaches a predetermined high level, a system hose for providing pressurized grout to a remote location, a control box attachable to said system hose in a remote location, a grout shutoff valve operating in conjunction with said control box, so that when a user exerts no force on said control box, said grout shutoff valve is on an OFF position and does not permit grout flow out of said control box, and so that when a user exerts a sufficient force on said control box, said grout shutoff valve is moved to an ON position to permit pressurized grout to flow out of said grout control box, and a fitting on said control box for accepting a grout applicator tool.

16. A system as recited in claim 15 wherein said valve may be caused to be only partially open in order to permit a reduced flow of pressurized grout from said control box.

17. A system as recited in claim 15 wherein release of pressurized grout from said control box through said valve causes a drop in grout pressure in said system, activating said switch to turn said grout pump on and increase grout pressure in the system.

18. A system as recited in claim 15 further comprising a grout applicator tool attachable to said fixture.

19. A system as recited in claim 15 further comprising:

a consistency valve in fluid communication with a water source, a grout pipe supplying pressurized grout to said consistency valve, and a consistency valve outlet leading to said hopper;

wherein when grout within the system becomes sufficiently viscous, it forces said consistency valve open, allowing water to flow from said consistency valve to said hopper, thereby reducing grout viscosity.

* * * * *